United States Patent [19]

Engebretson et al.

[11] Patent Number: 4,548,082

[45] Date of Patent: Oct. 22, 1985

[54] HEARING AIDS, SIGNAL SUPPLYING APPARATUS, SYSTEMS FOR COMPENSATING HEARING DEFICIENCIES, AND METHODS

[75] Inventors: A. Maynard Engebretson, Ladue; Robert E. Morley, Jr., Richmond Heights; Gerald R. Popelka, Ladue, all of Mo.

[73] Assignee: Central Institute for the Deaf, St. Louis, Mo.

[21] Appl. No.: 645,004

[22] Filed: Aug. 28, 1984

[51] Int. Cl.[4] ..... H04R 29/00

[52] U.S. Cl. ..... 73/585; 179/107 FD; 128/746

[58] Field of Search ..... 73/585; 128/746; 179/107 FD, 107 E, 107 R; 381/68; 364/415

[56] References Cited

U.S. PATENT DOCUMENTS

| | | | |
|---|---|---|---|
| 3,757,769 | 9/1973 | Arguimbau et al. | 128/746 |
| 3,818,149 | 6/1974 | Stearns et al. | 179/107 FD |
| 3,927,279 | 12/1975 | Nakamura et al. | 179/107 FD |
| 4,099,035 | 7/1978 | Yanick | 179/107 FD |
| 4,187,413 | 2/1980 | Moser | 179/107 FD |
| 4,188,667 | 2/1980 | Graupe et al. | 364/724 |
| 4,251,686 | 2/1981 | Sokolich | 73/585 |
| 4,390,748 | 6/1983 | Zwicker | 73/585 |
| 4,403,118 | 9/1983 | Zollner et al. | 179/107 FD |
| 4,489,610 | 12/1984 | Slavin | 73/585 |

FOREIGN PATENT DOCUMENTS

| | | |
|---|---|---|
| 2808516 | 6/1979 | Fed. Rep. of Germany . |
| 624524 | 7/1981 | Switzerland . |

OTHER PUBLICATIONS

"Statistical Measurements on Conversational Speech" by H. K. Dunn et al., *J. Acoust. Soc. Am.*, vol. 11, Jan. 1940, pp. 278–288.

"American National Standard Methods for the Calculation of the Articulation Index,", *ANSI Standard S.* 35--Jan. 1969, 25 pages.

"A Computer Program for Designing Optimum FIR Linear Phase Digital Filters", by J. H. McClellan et al., *IEEE Trans. Audio and Electroacoustics*, vol. AU-21, No. 6, Dec. 1973, pp. 506–526.

"Optimum FIR Digital Filter Implementations for Decimation, Interpolation, and Narrow-Band Filtering", by R. E. Crochiere et al., *IEEE Trans. Acoust. Speech, and Signal Proc.*, vol. ASSP-23, No. 5, Oct. 1975, pp. 444–456.

"Clinical Implications of Nonverbal Methods of Hearing Aid Selection and Fitting", by D. P. Pascoe, *Seminars in Speech, Language and Hearing*, vol. 1, No. 3, Aug. 1980, pp. 217–229.

"A Computer Program for Fitting a Master Hearing Aid to the Residual Hearing Characteristics of Individual Patients", by A. M. Engebretson et al., *J. Acoust. Soc. Am.*, 72(2), Aug. 1982, pp. 426–430.

"An Approach to Hearing Aid Selection", D. P. Pascoe, *Hearing Instruments*, Jun. 1978.

"The Implementation of Frequency Selective Amplification", G. R. Popelka, Annual Meeting of ASHA, Nov. 23, 1981.

"A Computer-Based System for Hearing Aid Assessment", G. R. Popelka et al., *Hearing Instruments*, vol. 34, No. 7, 1983, pp. 6–9, 44, 53.

*Primary Examiner*—Stephen A. Kreitman

*Attorney, Agent, or Firm*—Senniger, Powers, Leavitt and Roedel

[57] ABSTRACT

A hearing aid including a microphone for generating an electrical output from sounds external to a user of the hearing aid, an electrically driven receiver for emitting sound into the ear of the user of the hearing aid, and circuitry for driving the receiver. The circuitry drives the receiver in a self-generating mode activated by a first set of signals supplied externally of the hearing aid to cause the receiver to emit sound having at least one parameter controlled by the first set of externally supplied signals and then drives the receiver in a filtering mode, activated by a second set of signals supplied externally of the hearing aid, with the output of the external microphone filtered according to filter parameters established by the second set of the externally supplied signals. Other forms of the hearing aid, apparatus for supplying the sets of signals to the hearing aid in a total system, and methods of operation are also described.

57 Claims, 19 Drawing Figures

12
TO EAR
79
81
77
75
65
61
64
129
131
133
135
AAF
AAF
S/H1
S/H2
121
123
101
141
DAC
REG
119
119A
169
115
117
113
155
RAM
ROM
DSP
PI
INT R
PORT ADR
DECODER
CONTROL LATCH
127
125
167
175
POR
171
151
SERIAL INTER-FACE
153
REG
ADC
111
111A
S/H -IN
109
105
M U X
SIG. CONDX
107
103
SIG. CONDX
IN
OUT
SERIAL LINES
167
169
HOST COMPUTER
162
VEXT
163
164
32
69
69'
NC
163'
164'
BATTERY
71

DSP DOWNLOAD MONITOR

STIMULUS GENERATOR

DIGITAL FILTER

HEARING AIDS, SIGNAL SUPPLYING APPARATUS, SYSTEMS FOR COMPENSATING HEARING DEFICIENCIES, AND METHODS

BACKGROUND OF THE INVENTION

This invention relates to hearing aids, systems for compensating hearing deficiencies of a patient, signal supplying apparatus for use in such systems, and methods for compensating hearing deficiencies. More specifically, the invention relates to hearing aids which can respond to externally supplied electrical signals or generate signals for external use, or both, and to apparatus for externally supplying the electrical signals, and methods of operation of the signal supplying apparatus when connected to a hearing aid.

A person's ability to hear speech and other sounds well enough to understand them is clearly important in employment and many other daily life activities. Professional services which have as their goal to compensate or at least ameliorate hearing deficiencies of hearing impaired persons are consequently important to the community. Unfortunately, such services have in the past been subject to practical difficulties and errors.

For example, in a known approach, the patient's residual hearing has been measured and then a hearing aid has been selected from among different manufacturers and models. The length of time spent in measuring the patient's residual hearing and in selecting a "best" hearing aid from among the different manufacturers and models has been burdensomely long (about two hours). Moreover, the hearing aid selected during the evaluation is often not the actual instrument purchased and then worn by the patient, but is the same model and therefore is representative. Even if a particular hearing aid meets ANSI-1982 specifications, the amplification of the purchased hearing aid instrument can, because of manufacturing variations, differ considerably from that of the trial aid used during the evaluation. Ear canal and earmold effects, which can modify gain and maximum power output by as much as 30 dB, have been difficult to determine precisely and quickly on an individual basis. It has been difficult to accurately measure the patient's residual hearing and the performance of even the trial aid due to assumptions that are conventionally made in calibrating the acoustic characteristics of the audiometer and hearing aids, introducing error into the estimation of sound pressure levels in the patient's ear.

A large amount of information is required in order to simply repeat a particular test condition. Recordkeeping has become difficult and expensive to implement in a reasonable amount of time. And most of the foregoing problems recur should it be necessary to replace a lost or damaged hearing aid.

SUMMARY OF THE INVENTION

Among the objects of the present invention is to provide improved hearing aids that can be accurately custom fitted in performance characteristics to each individual patient and then worn home; to provide improved hearing aids that improve the accuracy of hearing measurements and hearing aid fitting; to provide hearing aids of the foregoing type wherein at least one or more of the hearing aid improvements made to achieve advantages in the fitting of the hearing aid also keeps the fit optimal after the fitting procedure is over and the patient has gone home; to provide improved hearing aids which respond to externally supplied electrical signals or generate signals for external use, or both; to provide improved apparatus and methods for externally supplying the electrical signals to such a hearing aid; to provide improved hearing aid fitting systems including the foregoing apparatus communicating with such a hearing aid; to provide improved methods, apparatus and systems for controlling the functions and characteristics of a hearing aid; to provide improved methods, apparatus and systems for fitting a hearing aid which can automatically take into account manufacturing variations in at least some components of the hearing aid; to provide improved hearing aids which have low noise and low distortion; to provide improved methods, apparatus and systems for automatically determining the patient's hearing threshold, most comfortable listening level, and uncomfortable listening level; to provide improved hearing aids, apparatus, systems, and methods that can compensate the hearing deficiencies of a patient with an accuracy of fit more closely approximating a research laboratory ideal fit; to provide improved apparatus, systems and methods that can be used to fit hearing aids to patients with at least comparable accuracy to conventional fitting in significantly less time; to provide improved apparatus, systems and methods to fit a hearing aid to a patient that adaptively reach a final setting of the hearing aid that yields maximum comfort and speech intelligibility for the patient; to provide improved hearing aids that can be efficiently replaced; and to provide improved hearing aids that are economical, wearable, and reliable.

Other objects and features will be in part apparent and in part pointed out hereinafter.

Generally, and in one form of the invention, a hearing aid includes a microphone for generating an electrical output from sounds external to a user of the hearing aid, an electrically driven receiver for emitting sound into the ear of the user of the hearing aid, and circuitry for driving the receiver in a self-generating mode activated by a first set of signals supplied externally of the hearing aid to cause the receiver to emit sound having at least one parameter controlled by the first set of externally supplied signals and for then driving the receiver in a filtering mode, activated by a second set of signals supplied externally of the hearing aid, with the output of the external microphone filtered according to filter parameters established by the second set of the externally supplied signals.

Generally, and in another form of the invention a hearing aid has a body adapted to be placed in communication with an ear canal, and the hearing aid body has an external microphone sensitive to external sound, and a receiver for supplying sound to the ear canal. The hearing aid includes a probe microphone in the hearing aid body for sensing the sound present in the ear canal, and circuitry connected to the external microphone and the probe microphone for driving the receiver in response to both the external microphone and the probe microphone, and for generating a digital signal for external use in adjusting the performance of the hearing aid, the digital signal representing at least one parameter of the sound sensed by the probe microphone.

Generally, and in yet another form of the invention the hearing aid includes the probe microphone and circuitry connected to the external microphone for filtering, then limiting, and then filtering the output of the external microphone according to a set of internal parameters and for selfadjusting at least one of the internal parameters as a function of the output of the probe microphone, thereby to drive the receiver.

In general, and in an additional form of the invention, the hearing aid includes the probe microphone and digital computing circuitry in the hearing aid coupled to the external microphone, to the probe microphone and to the receiver. The digital computing circuitry is adapted for connection to an external source of programming signals, and loads and executes entire programs represented by the signals and thereby utilizes the probe microphone, the external microphone and the receiver for hearing testing and digital filtering.

Generally, and in a system form of the invention for compensating hearing deficiencies of a patient, the system includes a hearing aid having an external microphone, programmable circuitry for filtering the output of the external microphone, and a receiver driven by the programmable filtering circuitry for emitting sounds into the ear of the patient. The system has means for sensing responses of the patient to sounds from the receiver. The system further includes apparatus communicating with the hearing aid and the sensing means, for selectively generating a first set of signals to cause the programmable filtering circuitry in the hearing aid to operate so that the receiver emits sounds having a parameter controlled by the first set of signals, and for then generating in response to the sensing means a second set of signals determined from the controlled parameter and the responses of the patient to the sounds with the controlled parameter to establish filter parameters in the programmable filtering circuitry to cause it to filter the output of the external microphone and to drive the receiver with the filtered output thereby ameliorating the hearing deficiencies of the patient.

In general, and in another system form of the invention, the system includes a hearing aid having an external microphone, a programmable digital computer in the hearing aid and fed by the external microphone, a receiver fed by the programmable digital computer for emitting sounds into the ear of the patient, and a probe microphone for sensing the actual sound in the ear of the patient. The system further incorporates a data link and apparatus for selectively supplying at least a first set and a subsequent second set of digital signals to the data link, the data link communicating the digital signals to the programmable digital computer of the hearing aid. The programmable digital computer in the hearing aid comprises means for selectively driving the receiver so that at least one sound for hearing testing is emitted into the ear in response to the first set of digital signals, for supplying to the data link a third set of digital signals representing a parameter of the output of the probe microphone, and for subsequently filtering the output of the external microphone in response to the subsequently supplied second set of digital signals to drive the receiver in a manner adapted for ameliorating the hearing deficiencies of the patient.

Generally, and in a form of the invention for use in a system including a hearing aid of the type described in the previous paragraph, signal supplying apparatus includes interface means for performing two-way digital serial communication with the digital computer in the hearing aid and circuitry for initiating transmission of a first set of signals from the interface means to the hearing aid to cause the digital computer in the hearing aid to operate so that the receiver emits sounds having an adjustable parameter. The circuitry also obtains, through the interface means, data representing values of the adjustable parameter of the sounds as sensed by the probe microphone, and then initiates transmission from the interface means of a second set of signals determined at least in part from the values of the parameter of the sensed sounds. The second set of signals causes the digital computer in the hearing aid to filter the output of the external microphone and drive the receiver with the filtered output, thereby ameliorating the hearing deficiencies of the patient.

In general, a method form of the invention is used for compensating hearing deficiencies of a patient with a hearing aid having an external microphone, electronic circuitry for processing the output of the external microphone, and a receiver driven by the electronic processing circuitry for emitting sound into the ear of the patient. The method includes the steps of selectively supplying a first set of signals to the hearing aid to cause the electronic processing circuitry to operate so that the receiver emits sound having a parameter controlled by the first set of signals. Representations of responses of the patient to the sound are sensed and electrically stored. Then a second set of signals is determined from the at least one controlled parameter of the sound and the representations of the patient responses to the sound with the controlled parameter. The second set of signals causes the electronic processing circuitry to filter the output of the external microphone and drive the receiver with the filtered output, thereby ameliorating the hearing deficiencies of the patient.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
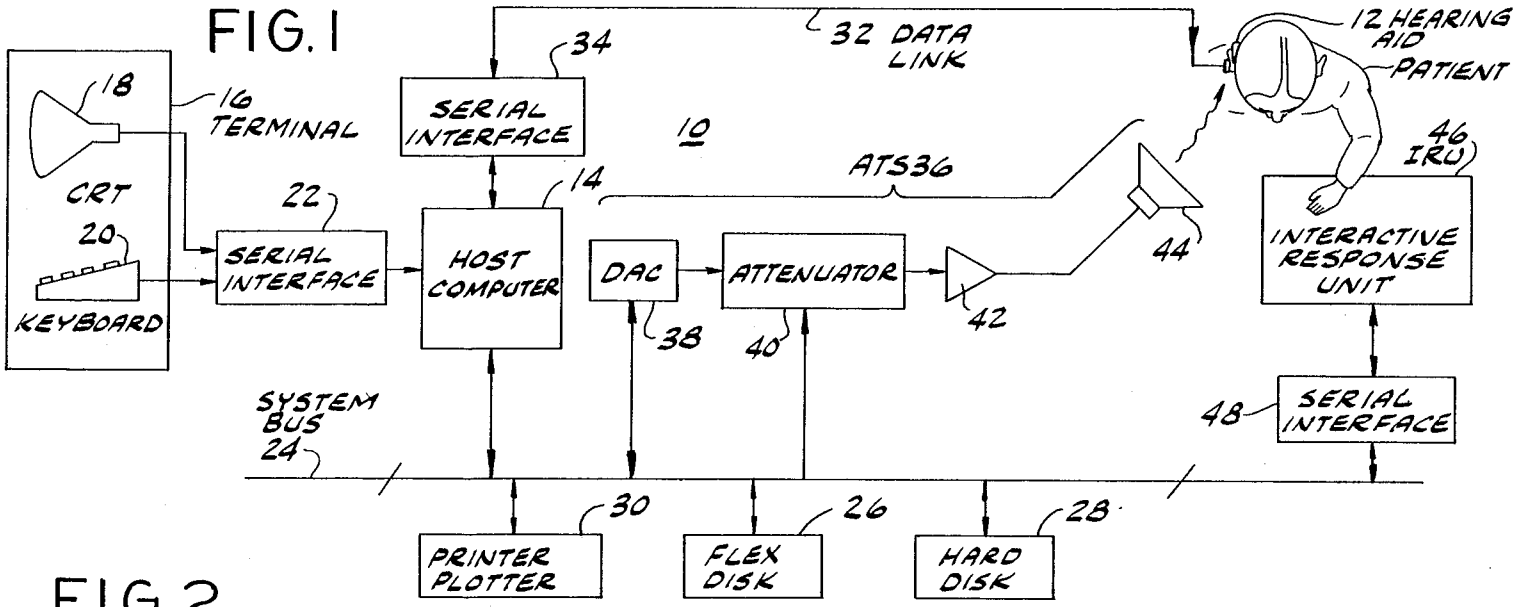
FIG. 1 is a block diagram of a system for compensating hearing deficiencies of a patient, the system including a hearing aid and signal supplying apparatus according to the invention.

In the preferred embodiments one model of hearing aid can be programmed to fit virtually all hearing impairments. The hearing aid used in the hearing test can be the aid worn home by the patient. Consequently, delay in the clinic between the traditional steps of initially testing the patient to specify the characteristics of the hearing aid and later retesting the patient with the representative finally-selected aid are eliminated. Also, because the hearing aid of a preferred embodiment includes a probe microphone, it is possible to measure the sound pressure in the ear both during testing and in normal use of the instrument. With the probe microphone in the hearing aid, testing and calibration are simplified, measurement of sound pressure in the ear is more accurate, and the overall input sound pressure to output sound pressure characteristics of the aid can be controlled more exactly in normal use. Furthermore, with digital processing techniques it is possible to adjust, more precisely, the gain and maximum power output functions on a frequency-selective basis.

The initial setting of the hearing aid parameters is done automatically by a host computer that is preferably programmed to use certain fitting rules which offer maximum speech intelligibility and comfort for the patient. These rules of fitting are: (1) amplification of conversational speech on a frequency-selective basis to fall within the listener's range of comfortable loudness levels between 200 Hertz and 6000 Hertz, and (2) control of the maximum output on a frequency-selective basis to fall below the listener's uncomfortable listening level over the same range of frequencies. A supplementary rule is that instrumentation noise and low-level background acoustic noise should fall below the listener's threshold if possible.

After the initial parameters have been determined, a fine tuning of the "fit" can be achieved with an adaptive procedure made possible by the programmable nature of the aid to reach an optimal setting. With the clinician operating the host computer, the patient makes rapid comparisons of speech intelligibility and comfort for various amplification characteristics until a satisfactory fit is achieved. In such a procedure, known as a paired-comparison procedure, the patient is asked to make "better" or "worse" judgments in a manner similar to that used in eyeglasses fitting procedures.

In the above-described hearing aid fitting procedure, instrument characteristics of the earmold and transducers are advantageously taken into account during the hearing aid evaluation. The hearing aid is worn by the patient during the test so that the acoustic characteristics of the hearing aid and earmold are included in the fitting procedure. Significant fitting errors that heretofore have arisen due to assumptions about calibration with standard test cavities (roughly simulating the ear canal) are eliminated.

During the test, the hearing aid is connected to the signal supplying apparatus, which has a host computer, via a serial communication data link that mediates the transfer of bidirectional digital signals consisting of signals for controlling test sounds, signals representing measurement data, and signals to program the hearing aid with appropriate signal processing characteristics. At the completion of the test, the hearing aid characteristics are optimized for the patient, the serial communication data link is disconnected, and the aid becomes a self-contained, self-adjusting unit that is worn home by the patient. Fewer clinical visits are required with concomitant advantages for the patient, clinician, employer and community.

Such data as are needed to regenerate a copy of the program for the hearing aid are archived by the host computer. If and when the hearing aid needs to be replaced, another hearing aid instrument is swiftly programmed with a regenerated copy of the program of the first aid modified in accordance with the calibration data of the replacement aid. In this way, the prior problems in hearing aid replacement are avoided.

In FIG. 1, a clinical test system 10 automatically controls the characteristics of a hearing aid 12 and generates stimulus sounds and sequences used in testing the patient's hearing. The system 10 has a small computer 14, herein also called a "host computer." Host computer 14 has an associated terminal 16, including a cathode ray tube (CRT) 18 and a keyboard 20 communicating through a serial interface 22, using conventional electronic technique. Host computer 14 communicates on a system bus 24 with flexible disk mass data storage unit 26, a high-capacity hard disk data storage unit 28, and a printer/plotter 30. Host computer 14 programs hearing aid 12 and receives measurement data back from it by means of a data link 32 and a serial interface 34.

The host computer 14 also communicates with an audiological testing subsystem (ATS) 36, which includes a digital-to-analog converter (DAC) 38, signal attenuator 40, a signal amplifying device such as a high-fidelity power amplifier 42, and a loudspeaker 44. At the election of the clinician operator at terminal 16, host computer 14 either disables ATS 36, or causes ATS 36 to emit test sounds from loudspeaker 44 from a repertoire including tones, narrow band noise, samples of speech, and other stored sounds. The repertoire is illustratively stored on disk 26 or 28. ATS 36 constitutes means controlled by an initiating or generating means (e.g., host computer 14), for selectively producing hearing test sounds in the vicinity of hearing aid 12. ATS 36 is thus an acoustic source for providing hearing test sounds to the external microphone of the hearing aid 12 and is controlled by the host computer 14.

An interactive response unit (IRU) 46 is provided for the patient to use in registering responses to the sounds heard through hearing aid 12 during the test. The IRU 46 senses the patient's responses and digitally communicates the response data back to host computer 14 through a serial interface 48. IRU 46 can be three push-button switches corresponding to barely audible sound, comfortable sound, and uncomfortably loud sound. However, greater flexibility is achieved with a touch-screen video unit for IRU 46 in which host computer 14 can display patient response instructions and choices on the screen. Then the patient touches a display choice area on the screen to register a response to sound. IRU 46 in a third form is implemented as a terminal unit identical to terminal 16, and the patient enters responses through a keyboard thereof.

Figure 2:
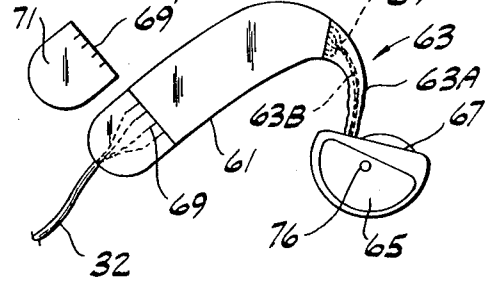
FIG. 2 is a view of the exterior of a hearing aid according to the invention for use in the system of FIG. 1.

In FIG. 2, hearing aid 12 has an electronics module 61, an earhook cable assembly 63, and a transducer module 65 retained within an ear mold 67 for insertion into the ear of the patient. Earhook cable assembly 63 includes a flexible plastic tapered tube 63A surrounding a cable 63B having six fine insulated conductors terminated at a miniature connector 64 that plugs into the electronics module 61 worn behind the ear. The earhook cable assembly 63 can be manufactured in several different lengths to accomodate different sizes of ears. Data link 32 attaches to electronics module 61 by means of a connector 69 and provides temporary power to the hearing aid as well as serving as a communications medium. When the testing is completed, connector 69 and data link 32 are removed from the hearing aid 12, and a rechargeable battery pack 71 is snapped in place against electronics module 61 for powering the hearing aid in normal use.

Figure 3:
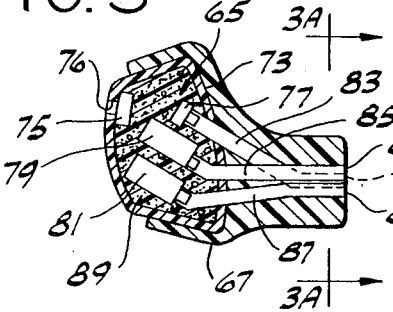
FIG. 3 is a cross-section of a transducer module and earmold part of the hearing aid of FIG. 2, which part is to be put in the patient's ear.

In FIG. 3, the transducer module 65 has a plastic casing 73 containing a microphone 75 mounted for receiving external sound. Microphone 75 is called an "external microphone" herein because it receives external sound, even though, as shown, it is not physically external to the hearing aid 12. Sound enters the hearing aid at a port 76 positioned in the transducer module 65 to take advantage of the acoustic amplification and directivity of the external ear. Casing 73 also contains a second microphone 77, which is called a "probe microphone" herein because it receives sound from the ear canal.

Further contained in the casing 73 is a composite receiver constituted by a woofer 79 and a tweeter 81. A "receiver" as the term is used in the hearing aid art is not a microphone, but a sound emitting means analogous in function to a telephone receiver. (The hearing aid receiver is generally different in construction and much smaller than a telephone receiver.) Woofer 79 is an electrically driven device for emitting sound into the ear of the user of the hearing aid 12 in a low frequency range, and tweeter 81 is similar except that it emits sound in a high frequency range. Together, they are able to cover the entire spectrum of nominally 200 to 6000 Hz. with sufficient fidelity to accomodate the hearing needs of the hearing impaired patient.

Thus, external microphone 75 constitutes a microphone for generating an electrical output from sounds external to a user of the hearing aid, and woofer 79 and tweeter 81 constitute an electrically driven receiver for emitting sound into the ear of the user of the hearing aid. Transducer module 65 constitutes a body adapted to be placed in communication with an ear canal, the hearing aid body having an external microphone sensitive to external sound, a receiver for supplying sound to the ear canal, and a probe microphone for sensing the sound present in the ear canal. The electrical drive for the woofer and the tweeter is separated into high and low frequency ranges. The separation feature reduces processing noise and improves dynamic range. As such, the receiver comprises a plurality of transducers driven by a driving means in distinct frequency ranges respectively.

Probe microphone 77, woofer 79 and tweeter 81 are acoustically connected by respective sound tubes 83, 85, and 87 to the ear canal, when the hearing aid is in place. The sound tubes form a bundle having an outside diameter of approximately 5 millimeters or less, oriented at 45° toward the center line of the head of the patient. The sound tube for the probe microphone 77 has an approximately 1.5 millimeter inside diameter and is about 24 millimeters long.

Figure 3A:
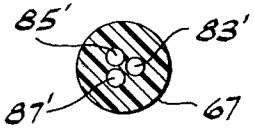
FIG. 3A is a section on line 3A—3A of FIG. 3 illustrating channels in the ear mold part of the hearing aid of FIGS. 2 and 3.

As shown in FIG. 3A as well as FIG. 3, ear mold 67 is a soft molded plastic element that is inserted into the ear when the hearing aid is used. Ear mold 67 has one or more channels admitting sound tubes 83, 85, and 87 to respective apertures 83', 85', and 87'.

External microphone 75, probe microphone 77, woofer 79, and tweeter 81 are acoustically isolated from each other in casing 73 by a cushioning foam material 89. Woofer 79 and tweeter 81 are suspended in the material 89 while external microphone 75 is affixed to casing 73. This provides an additional degree of acoustic isolation and freedom from feedback squealing.

Figure 4:
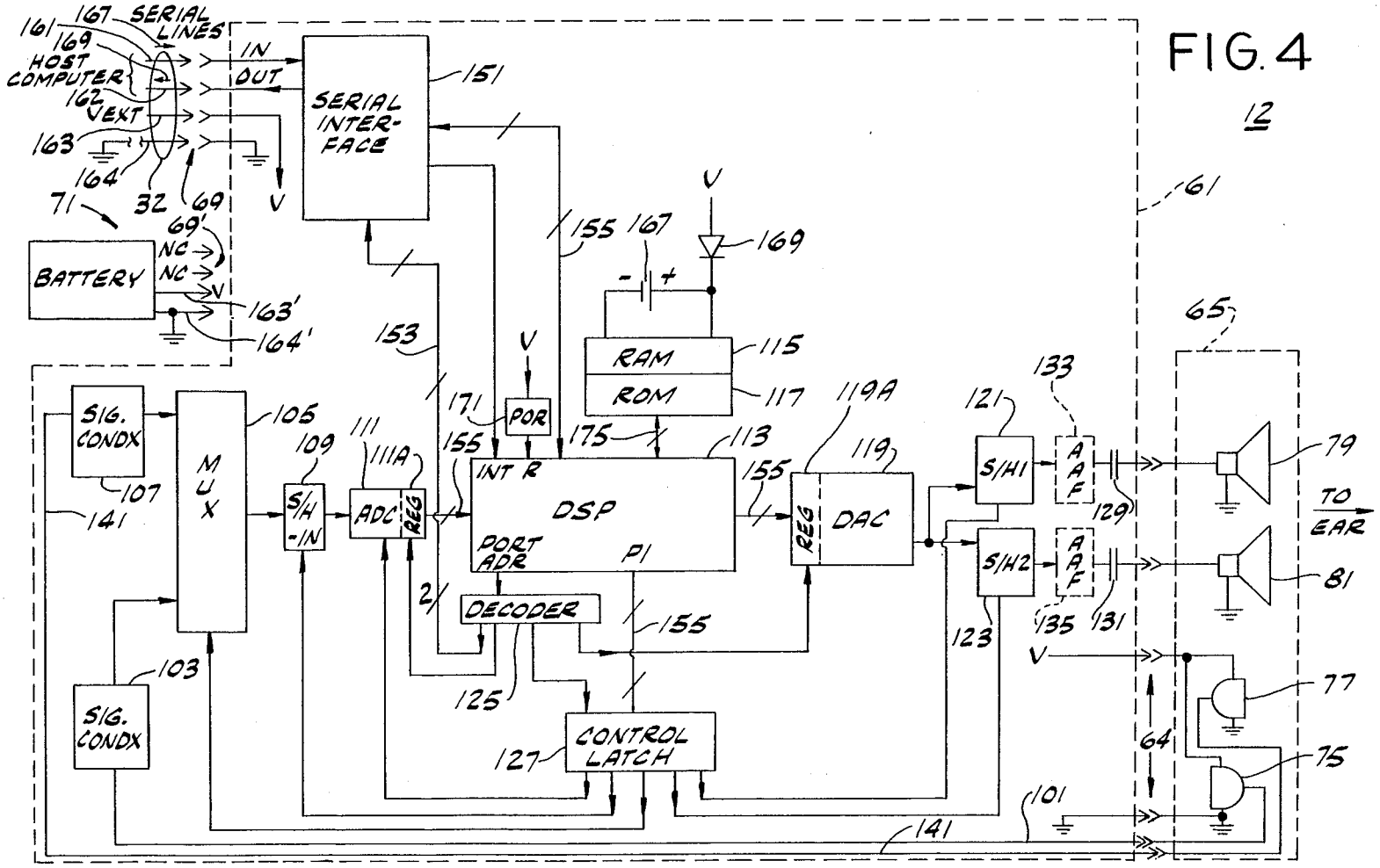
FIG. 4 is a block diagram of the electronic circuitry of the hearing aid of FIG. 2.

In FIG. 4, sounds are received at the external microphone 75, such as a commercially available Knowles model EA 1845 subminiature electret condenser microphone. This microphone has wide bandwidth (150–8000 Hz.), smooth response (±5 dB), small volume (0.051 cc.), good electrical stability and low sensitivity to vibration. External microphone 75 is energized by lines to voltage V and ground, and produces an electrical output on a line 101 connected to a signal conditioning circuit 103.

Signal conditioning circuit 103 applies a preemphasis, or "tilt", of 6 db per octave rising with frequency for frequencies below 6 KHz., and then applies signal compression. The signal compression is part of a companding approach in which the compression is complemented with expanding in software. Signal conditioning circuit 103 produces a preemphasized band limited (anti-aliasing) and compressed output which is converted into discrete digital samples by combined actions of a multiplexer (MUX) 105, a sample-and-hold circuit (S/H-IN) 109 and an analog-to-digital converter (ADC) 111. The nominal sampling rate for each channel of MUX 105 is 50 KHz.

Anti-aliasing filter of signal conditioning 103 relatively flat from 0 to 6 KHz. and drops off "fast" enough (in dB per octave) to ensure that there is negligible spectral energy above 25 KHz. Signal conditioning 103 should provide about 5 volts output with 89 dB sound pressure level at the microphone input. For an EA series microphone with sensitivity of about −60 dB re 1 volt per microbar, voltage gain at 1 KHz should be about 60 dB. Above 6 KHz., to reduce the effects of aliasing, the system response should roll off at −30 dB per octave to assure an adequately low (−60 dB) signal at the Nyquist rate of 25 KHz (12.5 KHz. per channel).

ADC 111 is connected to a digital signal processor (DSP) 113 and is constructed with conventional electronic technique to implement a 16-bit successive approximation conversion procedure. This results in fast conversions to produce digitized samples with 16 bits of dynamic range and adequate precision for small signals. When preemphasis and compression are applied by use of the signal conditioning circuit 103, the signal-to-quantizing-noise ratio is increased to a high level. Accordingly, it is contemplated that the skilled worker will reduce the number of bits of conversion in the ADC 111 to a minimum (10 or even 8 bits) consistent with acceptable level of signal-to-noise ratio, when the reduced complexity in ADC 111 more than offsets in value the use of signal conditioning circuit 103 and expander software in DSP 113.

The digitized samples are processed by digital signal processor (DSP) 113, which consists of a flexible array of electronic logic elements that can be programmed to self-generate waveforms corresponding to test sounds, to provide an extremely wide range of filter characteristics for the hearing aid, to process and report data from the probe microphone, to gather and report data on the filtering operations, and perform other functions. DSP 113, for example, is a 16 bit microprocessor chip fabricated according to VLSI (very large scale integration) to physically fit in electronics module 61. Associated with DSP 113 is a random access memory (RAM) 115 and read-only memory (ROM) 117.

In its filtering mode of operation, DSP 113 acts as four contiguous 8th-order band-pass filters that extend over a total range of frequencies from 200 to 6000 Hertz in four bands 240–560 Hz., 627–1353 Hz., 1504–3412 Hz., and 3755–5545 Hz. The bands or ranges are respectively given range numbers F=1, 2, 3 and 4. DSP 113 is programmed in its filter mode to execute digital filtering operations (described more fully in connection with FIG. 17) in the four bands. Several alternative filtering algorithms can be used. These include both Infinite Impulse Response (IIR) and Finite Impulse Response (FIR) filters. DSP 113 is equally capable of performing any of the alternatives, and only the program needs to be changed to implement an alternate method. The IIR type is believed to produce somewhat greater roundoff noise compared to that produced by the FIR. Accordingly, the FIR is disclosed in the preferred embodiment due to its superior signal-to-noise ratio.

DSP 113 produces a succession of digital signals that are converted to analog form by a digital-to-analog converter (DAC) 119. The output from DAC 119 is a succession of analog levels representing the sum of the digital filter outputs in the lower frequency bands F=1 and 2, alternating with the sum of the digital filter outputs in the higher frequency bands (F=3 and 4). The output of DAC 119 is connected to first and second sample-and-hold circuits (S/H1 and S/H2) 121 and 123. Sample-and-hold circuits 121 and 123 are alternately enabled by DSP 113 through a decoder circuit 125 and a control latch 127 so that the analog levels for the lower frequency bands F=1 and 2 appear at the output of S/H1 and the analog levels for the higher higher frequency bands F=3 and 4 appear at the output of S/H2. In this way the analog levels are routed to separate higher and lower frequency output channels.

Each sample-and-hold circuit 121 and 123 is not allowed to sample the output of DAC 119 during the first half of the settling period of DAC 119. The reasoning is that the DAC 119 is alternately producing independent signals. This can cause many jumps in its output. These jumps are isolated from the sample-and-hold circuits 121 and 123, and thus from the ear of the patient, by waiting for DAC 119 to at least partially settle before enabling the sample-and-hold circuits.

At this point it is useful to return briefly to the discussion of the advantage of two output channels. Either output channel, in an example circuit operation with 8-bit digital representation, may produce an intense tone of 80 dB SPL with an audible quantization noise floor of 32 dB (i.e. a signal to noise ratio of 48 dB (6 dB×8 bits)). (Quantization noise is produced by the digitizing process.) Due to the attenuation of out of band frequencies provided by the woofer and tweeter the quantization noise is suppressed well below that achievable with a single receiver design.

Woofer 79 and tweeter 81 are respectively fed by S/H1 and S/H2 through coupling capacitors 129 and 131 respectively. Woofer 79 and tweeter 81 are commercially available Knowles model CI-1955 and EF-1925 units. Woofer 79 responds to low frequency signals below about 1500 Hz. (to encompass frequency bands F=1 and 2), and tweeter 81 responds to signals above about 1500 Hz. (frequency bands F=3 and 4). The response of a Knowles tweeter can be made very low below frequencies of 1500 Hz. by drilling a very small hole (less than 1 mm.) in the case of the receiver itself to couple by an acoustic mass the front and rear of the diaphragm. At low frequencies where the mass reactance is low, most of the volume velocity that otherwise is directed out of the sound port is advantageously shunted to the rear of the diaphragm.

It is contemplated that woofer 79 and tweeter 81 together with the natural filtering characteristics of the ear will provide a significant and adequate degree of anti-aliasing filtering for the output channels. However, filtering, and power gain can be added in the lower and higher frequency output channels by optional anti-aliasing filters 133 and 135. When preemphasis is applied in signal conditioning circuit 103, deemphasis is applied in the filters 133 and 135. (Deemphasis can alternatively be programmed into the digital filter software of DSP 113 if it is desired to omit the analog filtering.) Small push-pull amplifiers manufactured by Linear Technology or Texas Instruments can be used to supply the power gain for exciting the woofer/tweeter combination.

The probe microphone 77, such as a commercially available Knowles EA 1934 subminiature electret condenser microphone, is connected by a line 141 to a signal conditioning circuit 107. Signal conditioning circuit 107 applies a gain of about 8 dB and optionally compresses the signal from the probe microphone output 141 to provide a second input to multiplexer 105. Probe microphone 77 constitutes a second microphone adapted for sensing sound in the ear of the user of the hearing aid. DSP 113 receives a succession of digital signals from ADC 111 representing values of conditioned output from the external microphone 75 alternating with values of output from the probe microphone 77. DSP 113 through the decoder circuit 125 and the control latch 127 sequentially enables MUX 105 for the external microphone, enables S/H-IN 109, and then ADC 111. After the just mentioned sequence, DSP 113 sequentially enables MUX 105 for the probe microphone, enables S/H-IN 109, and then ADC 111. In the embodiment of FIG. 4 the output from the probe microphone bypasses signal conditioning circuit 103 and does not receive preemphasis, to avoid complications in interpreting the output of ADC 111 for the probe channel. In this way, the analog levels representing the values of signal from the external microphone and from the probe microphone are multiplexed and converted to corresponding digital representations fed to DSP 113.

Thus MUX 105 has respective inputs for coupling to the probe microphone 77 and to the external microphone 75, and the output of MUX 105 is coupled to DSP 113 by way of S/H-IN 109 and ADC 111. Signal conditioning circuit 103 constitutes means for coupling the output of the external microphone with preemphasis or compression or both, to one of the inputs of MUX 105. Signal conditioning circuit 103 applies the preemphasis and/or compression to the output of the external microphone, and the probe microphone is connected via signal conditioning circuit 107 to MUX 105 so as to bypass the preemphasis means (e.g., circuit 103).

DSP 113 is a processor with sufficiently fast hardware and software to complete its input, computation, and output operations in about 80 microseconds (reciprocal of sampling rate of 12.5 KHz.) for each of many loops. The dynamic range and signal-to-noise ratio are improved by the use of 16-bit digital representations, so a 16-bit processor is preferred. A Texas Instruments TMS-320 microprocessor or its equivalent is a suitable choice for DSP 113.

The TMS-320 has a data area contained within while a program area is connected externally. The data memory is 144 words by 16 bits and the program memory is 4096×16. The program memory is separated into the ROM area 117 and the RAM area 115. The ROM area contains the monitor program for DSP 113 (see FIG. 12), while the RAM area is loaded by the monitor (see FIG. 13). In the practice of the invention the skilled worker should increase or decrease the nominal 4K of memory to the minimum memory required to accommodate the operations implemented, or including those likely to be implemented in the forseeable future.

There are eight I/O ports associated with the TMS-320, which are available for local peripherals. The skilled worker may make any appropriate port assignment for a serial interface 151, ADC Register 111A, control latch 127 and DAC Register 119A.

The TMS-320 utilizes programmed input-output (I/O) with an I/O space of 8 words. I/O cycles and memory cycles are for the most part identical, the biggest difference stemming from the fact that the TMS-320 overlaps instruction and data fetches. Since all data fetches are internal to the TMS-320, these are done concurrently with the instruction fetch for the next cycle. This means that, although data is transferred in the same amount of time for memory references and I/O references, I/O references can only occur every other cycle because the IN or OUT instruction must be fetched over the same bus on which the I/O transfer will take place.

An entire bus cycle of the TMS-320 is about 200 nanoseconds. RAM 115 and ROM 117 should have access times around 90 nanoseconds for use with the TMS-320. A 2K×8 static complementary metal oxide semiconductor (CMOS) RAM of type IDT6116S is a compatible chip for use as a memory building block. To accomplish quick decoding, the memory is divided as simply as possible (halves or quarters), with the RAM 115 being enabled for the higher-numbered words and the ROM 117 for the lower-numbered words.

The interrupt (INT) line on the DSP 113 is activated whenever a character is received from host computer 14 of FIG. 1 through the serial interface 151. DSP 113 also enables the serial interface 151 through decoder 125 and a 2 line control bus 153. Serial interface 151 is an asynchronous serial port which operates at programmable data rates up to 9600 baud and is of a readily available and conventional type. DSP 113 receives and sends information on a data bus 155 to serial interface 151, when the latter is enabled. In this way DSP 113 accomplishes two way serial communication with host computer 14 of FIG. 1 along data link 32.

The host computer 14 of FIG. 1 downloads programs and filter coefficients to the hearing aid 12 via serial interface 151. DSP 113 receives these programs and executes them. The serial data link to the host provides an effective means of monitoring the status of the hearing aid 12. Status information that can be reported to the host computer includes: probe microphone sound pressure level measurements, extent of clipping in the multiband filters, and power spectra of input signals or filter outputs.

Bus lines marked 155 are, for purposes of clarity in illustration, shown emanating from DSP 113 on the drawing to ADC Register 111A, to serial interface 151, to control latch 127 and to DAC Register 119A. These bus lines are all marked with the same numeral 155 because they are all part of the same data bus of DSP 113. ADC Register 111A has a tristate output, and other conventional arrangements are made so that bus 155 can be used in the multipurpose manner shown. Bus 155 is the data lines of a main bus 175. Main bus 175 not only has the data lines, but also address lines and control lines connected from DSP 113 to RAM 115 and ROM 117.

Data link 32 illustratively has four conductors 161, 162, 163 and 164 in a flexible cable. First and second conductors 161 and 162 therein carry transmissions in respective opposite directions 167 and 169 through connector 69 between the serial interface 34 of host computer 14 of FIG. 1 and the serial interface 151 of DSP 113. Third conductor 163 carries a power supply voltage $V_{EXT}$ derived from the conventional power supply (not shown) of the host computer 14 for temporary use as the hearing aid supply voltage V when hearing testing is being performed. Fourth conductor 164 is the ground return for data link 32 and for supply voltage $V_{EXT}$.

Connector 69 constitutes at least one external connector for making a digital signal (e.g., measurement data from probe microphone 77) externally available and for admitting additional digital signals so that the digital filtering means (e.g., DSP 113) can be programmed when the hearing aid is placed in communication with the ear canal.

The use of four conductors 161–164 in data link 32 allows for full duplex (simultaneous two-way) serial communication, and separates the DC supply conductor 163 from the information carrying conductors 161 and 162. Of course, as few as two conductors can be used if simplex (alternate one-way) serial communication is chosen, and components are added in electronics module 61 according to conventional technique for separating the supply voltage V from the serial digital signals on data link 32.

Battery pack 71 is shown in FIG. 4 with battery connections to two conductors 163' and 164' of a connector 69'. No connections (NC) are made to two other conductors of the connector 69'. When hearing testing is completed, the serial data link 32 and connector 69 are disconnected from module 61 and replaced by connector 69' which is snapped into place to provide supply voltage V. During the interval of disconnection, a tiny battery 167 maintains a voltage on volatile RAM 115 so that software which has been downloaded during the hearing aid fitting procedure is not lost. The RAM 115 is supplied with supply voltage V through diode 169 at all other times. When supply voltage V is restored, the reset R pin of DSP 113 is supplied with a pulse from a power-on reset (POR) circuit 171 such as a one-shot multivibrator to restart execution of a program.

In one aspect of its operations, DSP 113 constitutes means for driving the receiver in a self-generating mode activated by a first set of signals supplied externally of the hearing aid to cause the receiver to emit sound having at least one parameter controlled by the first set of externally supplied signals and for then driving the receiver in a filtering mode, activated by a second set of signals supplied externally of the hearing aid, with the output of the external microphone filtered according to filter parameters established by the second set of the externally supplied signals. When the probe microphone is used, DSP 113 also constitutes means coupled to the second microphone for also supplying a signal for external utilization, the signal representing the at least one parameter of the sound controlled by the first set of externally supplied signals. Connector 69 constitutes an external connector for making available the signal for external utilization from said driving means and for admitting the first and second sets of signals supplied externally of the hearing aid.

A small bootstrap monitor program resides in the ROM 117. The bootstrap monitor assists the host computer 14 of FIG. 1 in downloading selected programs from the host computer to the RAM 115 in just a few seconds. A typical downloading process entails the transmission of about 2K bytes of program to DSP 113 at a data rate of 9600 baud. This is completed in about 2 seconds.

Once the DSP 113 program is loaded, new filter coefficients and limiting values can be transmitted in less than a second once they are determined or selected from store by host computer 14 of FIG. 1. To facilitate a paired comparison fitting procedure, several sets of coefficients are advantageously computed in advance, and then the hearing aid filter characteristics are completely respecified at one second intervals.

Once a program is loaded, execution commences, and the hearing aid 12 is operational. Thus, DSP 113 also constitutes digital computing means in the hearing aid and coupled to the external microphone, to said probe microphone and to the receiver, and adapted for connection to the external source of programming signals, said digital computing means comprising means for loading and executing entire programs represented by the signals and thereby utilizing said probe microphone, the external microphone and the receiver for hearing testing and digital filtering.

DSP 113 is also programmed to control the power usage of various parts of the hearing aid to conserve battery life when input sound levels fall below a specified criterion.

Figure 5:
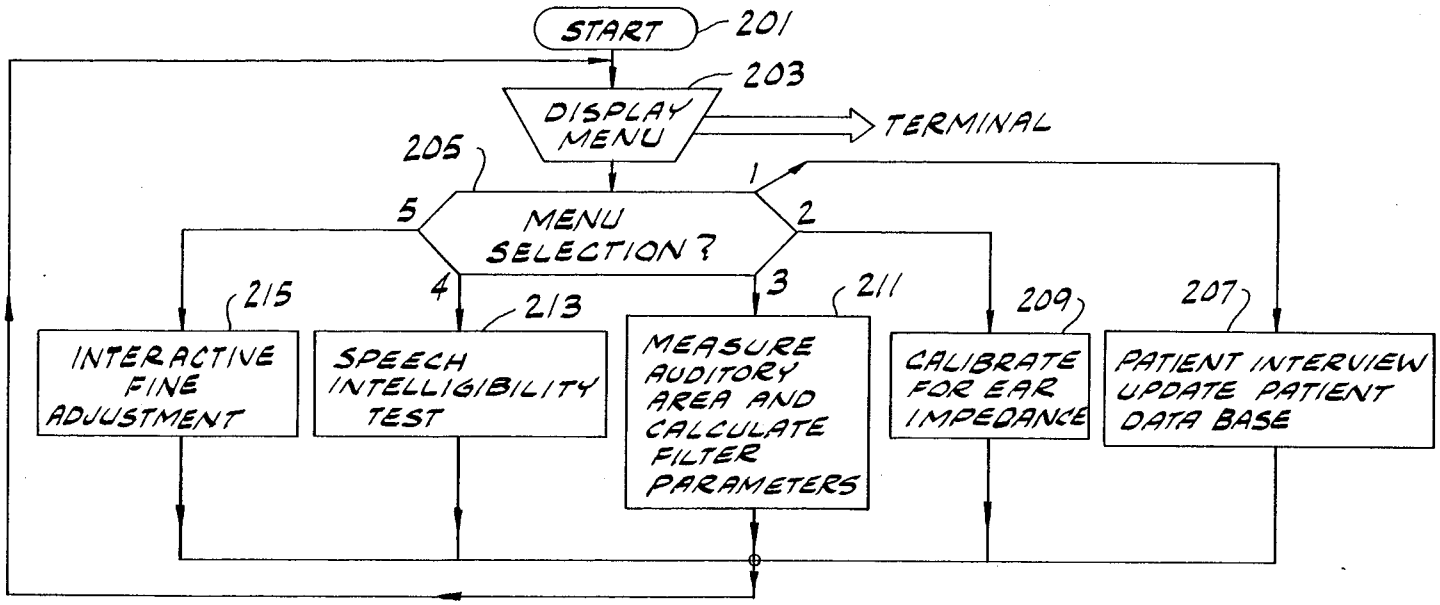
FIG. 5 is a flow diagram of operations according to a method of the invention performed by a host computer in the signal supplying apparatus of FIG. 1.

In FIG. 5, operations of host computer 14 commence with START 201 and proceed to a step 203 displaying menu options entitled:

"1. PATIENT INTERVIEW: UPDATE PATIENT DATABASE"
"2. CALIBRATE FOR EAR IMPEDANCE"
"3. MEASURE AUDITORY AREA AND CALCULATE FILTER PARAMETERS"
"4. SPEECH INTELLIGIBILITY TEST"
"5. INTERACTIVE FINE ADJUSTMENT"

The operator of the host computer selects one of the menu options, and in step 205 a branch is made to execute the selected one of the options. Option 1 is usually to be selected first and executed at step 207, whence operations return to step 203 so that another option can then be selected. A selected one of options 2, 3, 4, and 5 is then respectively executed at step 209, 211, 213, or 215.

Patient interview step 207 is a standard interactive database update routine wherein the computer flashes form questions on the CRT 18 of FIG. 1 and the operator asks the questions and enters the answers of the patient on keyboard 20 of FIG. 1. Host computer 14 of FIG. 1 stores the answers in the database either directly or after some intermediate processing in a manner familiar to the art. Accordingly, no further description of the database update routine is undertaken here.

Calibrating step 209 gathers preliminary data on the hearing aid and its characteristics when inserted in the patient's ear so that step 211 can be performed accurately. Step 211 then uses the data gathered in step 209 together with measurements of the auditory area (defining the patient's hearing) to then automatically calculate filter parameters which will make the hearing aid ameliorate the patient's hearing deficiency. The hearing aid 12 is programmed to operate in accordance with the automatically calculated filter parameters, so that further testing and fine tuning by the operator can be performed in steps 213 and 215 to make the fit as perfect as possible. It is contemplated that each menu option is performed once, in 1 through 5 order, but it is noted that each of the options on the menu can be accessed more than once and in any order to fulfill any procedural preferences of the operator. Also, if desired, one or more of the options can be omitted at the discretion of the operator.

Figure 6:
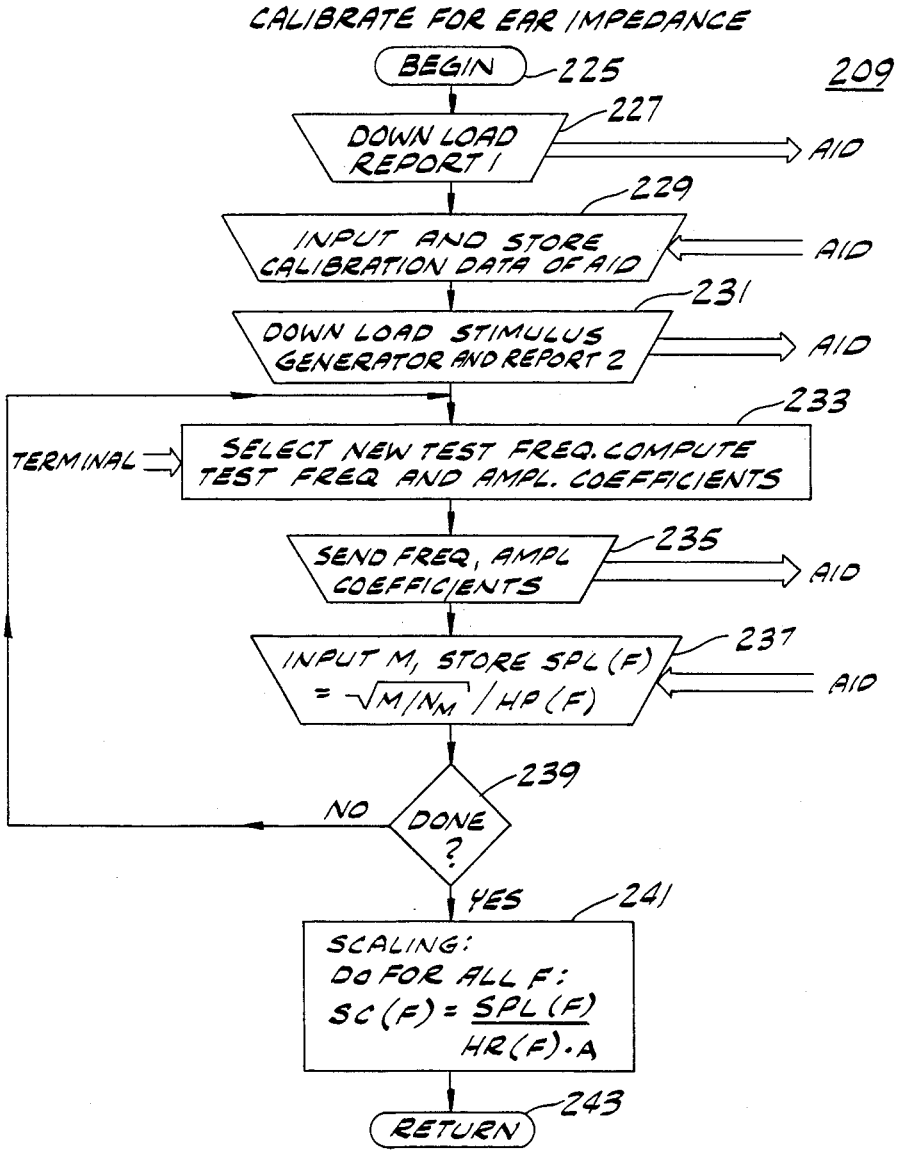
FIG. 6 is a flow diagram of operations of the host computer according to a method of the invention to calibrate for ear impedance.

In FIG. 6, the calibration for ear impedance, step 209, is itself divided into steps. Before describing the steps hereinbelow, the preliminary data sought is now discussed. Designations of the data and symbols for other quantities of interest are shown in Table I.

TABLE I

| QUANTITY | REMARKS |
|---|---|
| HE(F) | Magnitude of the transfer function of the path from external sound source through external microphone, to input of DSP 113 of FIG. 4 in frequency range numbered F |
| HR(F) | Magnitude of the transfer function of the path from DSP 113 of FIG. 4 output to standard coupler in frequency range numbered F |
| HP(F) | Magnitude of the transfer function of the path from ear canal through probe microphone to input of DSP 113 of FIG. 4 in frequency range numbered F |
| SC(F) | Magnitude of the compensation function required due to deviation of actual ear impedance from that of standard coupler at frequency F. (SC(F) (dB) = HR (F) measured on patient (dB) less HR(F) measured in test cavity (dB)) |

TABLE I-continued

| QUANTITY | REMARKS |
|---|---|
| A | Root mean-square (RMS) magnitude of waveform represented by the output of DSP 113 of FIG. 4 |
| SPL | RMS sound pressure level in ear canal |
| $\sqrt{M/N_m}$ | RMS input to DSP 113 from probe channel |

A transfer function for the present purposes is a set of complex numbers corresponding to a set of frequencies in the spectrum of interest. In the preferred embodiment, the spectrum from 0 to 6 KHz. is divided up into a plurality of frequency ranges given range numbers F from 1 to some counting number FO such as 4. More specifically, a transfer function is the ratio of the Fourier transform of the output at one point in a system to the Fourier transform of the input to another point in the system. For simplicity, the use of complex numbers is avoided herein by employing the magnitude of the transfer function, where the magnitude is a function of frequency, which function is defined as the square root of the sum of the squares of the real and imaginary parts of the transfer function at each frequency in the spectrum. It is also assumed that the magnitude of the transfer function in each one of the frequency ranges is substantially constant, so that computations are simplified. It is readily verified from a mathematical consideration of complex numbers that the magnitude of the transfer function is equal to the ratio of the root-mean-square of the output to the root-mean-square of the input. Moreover, paths or channels between points can be cascaded. The magnitude of the transfer function for the cascaded paths is the product of the magnitudes of the transfer functions of the respective paths.

In hearing aid 12, the output channel from DSP 113 to the woofer/tweeter receiver combination and ending in the ear volume (volume of the ear canal with hearing aid inserted), is regarded as a first path. This first path is cascaded with a second path constituted by the probe channel to DSP 113 from tube end 83' and including the probe microphone. Because facilities will not generally be available in the field to calibrate the receiver and the probe microphone, it is contemplated that factory calibration will be accomplished with a standard acoustic device called a "coupler" for simulating the ear volume. In the factory calibration of the hearing aid with the standard coupler, electrical output from DSP 113 is produced corresponding to a desired test sound in one of the frequency ranges at a time. This electrical output has a RMS value designated A and frequency range number F both of which can be predetermined or controlled from a host computer 14 at the factory. The value A is regarded as the input to the first path. The acoustic output from the first path, which is also the input to the second path at end 83' of the tube 83 to the probe microphone, is the RMS sound pressure level SPL. The RMS output of the second path is designated $\sqrt{M/N_M}$ for reasons described more fully hereinafter.

Both A and $\sqrt{M/N_M}$ can be measured or determined at the factory. SPL is measured by standard acoustic test equipment connected to the coupler at the factory. The transfer functions of the above-mentioned cascaded first and second paths are designated HR(F) and HP(F) respectively determined at the factory from the measured values of A, SPL, and $\sqrt{M/N_M}$ using the equations:

$$SPL(F)=HR(F)\times A \tag{1}$$

and $$\sqrt{M/N_M} = HP(F) \times SPL(F) \tag{2}$$

Similarly, the function HE(F) is the frequency-dependent ratio of the DSP 113 RMS input to an RMS sound pressure level supplied to the external microphone 75 from a standard sound source.

The functions HE(F), HR(F) and HP(F) determined at the factory are supplied on a data sheet sent with the hearing aid to the clinician in the field. In an even more advantageous feature of the invention, the functions HE(F), HR(F) and HP(F) are also loaded into the hearing aid memory so that they can be automatically retrieved by the host computer, thereby saving time and avoiding possible errors in entering the values from the data sheet into the host computer prior to the fitting procedure.

It is to be understood that the acoustic characteristics of the ear volume of the patient will in general be different from those of the coupler used at the factory. Consequently, it is desirable to calibrate for the ear impedance in the field. The modifying effect of the actual ear volume compared to the coupler is accounted for by a frequency-dependent compensation function SC(F) which is determined by the operations of the host computer shown in FIG. 6. (The term "compensation function" signifies a mathematical correction herein, and is not to be equated by itself with hearing deficiency "compensation", which is an overall goal of hearing aid fitting.)

In the calibration of the ear volume of FIG. 6, electrical output from DSP 113 is produced corresponding to a desired test sound in one of the frequency ranges at a time. This electrical output has an RMS value designated A and frequency range number F both of which can be predetermined or controlled from host computer 14. The value A is regarded as the input to the first path. The transfer functions of the above-mentioned cascaded first and second paths, with the patient's ear canal included, are designated (SC(F)×HR(F)) and HP(F) respectively. The acoustic output of the first path, which is also the input to the second path at aperture 83', is the RMS sound pressure level SPL. Accordingly, the cascaded paths are described by the equations:

$$\sqrt{M/N_M} = HP(F) \times SC(F) \times HR(F) \times A \tag{3}$$

$$SPL(F) = SC(F) \times HR(F) \times A \tag{4}$$

and $$\sqrt{M/N_M} = SPL(F) \times HP(F) \tag{5}$$

Since HP(F) is known, the $\sqrt{M/N_M}$ data obtainable from the probe microphone measurements can be used to determine the actual sound pressure level SPL(F) in the patient's ear. The value of A can be predetermined by the host computer also. Accordingly, and since the transfer function HR(F) is also known, the scaling function can be and is determined by host computer 14 by solving Equations (4) and (5) for SC(F).

Operations in host computer 14 commence in FIG. 6 with BEGIN 225 and proceed to step 227 to download a routine REPORT1 (FIG. 15) into the hearing aid for causing DSP 113 to send back the values of the transfer functions HE(F), HR(F) and HP(F) in each of the FO=4 frequency ranges. Next, at step 229, host computer 14 inputs and stores the values being sent back from the hearing aid. In step 231, a stimulus generator routine (FIG. 14) including a routine called REPORT 2 (FIG. 16) is downloaded from host computer 14 to the hearing aid. Thus, host computer 14 downloads an entire test sound generating program to the hearing aid as a first set of signals. In step 233 a test frequency in one of the frequency ranges and a desired value of A are selected by the operator so that the test sounds produced have a comfortable loudness level for the patient while the ear impedance calibration test is being performed. Coefficients for the stimulus generator routine are sent in step 235 to the hearing aid so that a test sound in the selected frequency range is emitted by the hearing aid into the patient's ear.

In step 237, host computer 14 receives a value M of sum-of-squares input in the probe channel of the hearing aid 12 from DSP 113 via REPORT 2. The value M is then divided by $N_M$ in the host computer 14 and the square root of this value is calculated to obtain an RMS value $\sqrt{M/N_M}$ which is divided by the value of probe microphone transfer function HP(F) for the value of F of the frequency range in which the test sound was generated. The result of the calculations is a value of measured sound pressure level SPL which is then stored in a table indexed according to frequency range in which the SPL measurement was taken.

At step 239 a branch back to step 233 is made to test sounds in all four frequency ranges. When data has been gathered, scaling step 241 is reached. In each frequency range F, the compensation function SC(F) is calculated in each frequency range F according to the formula:

$$SC(F)=SPL(F)/(HR(F)\times A) \quad (6)$$

where SPL(F) is the value in the SPL table corresponding to a given frequency range, HR(F) is the transfer function of the output channel in the hearing aid, and A is the RMS DSP 113 output used in producing the SPL(F). It is to be understood that the formula shown for step 241 is to be calculated four times so that all values of F are exhausted, a loop being omitted from the drawing for conciseness. Of course more than one value of SPL can be measured in each frequency range, and more than one value of A can be employed. In such case, all the data are accordingly tabulated in memory and indexed according to frequency. Then more than one value of SPL(F)/(HR(F)×A) is computed in each frequency range, and the resulting quantities averaged to produce a single calculated value of SC(F) in each frequency range. Upon completion of step 241, RETURN 243 is reached and operations return to step 203 of FIG. 5.

Figures 7, 8, 9:
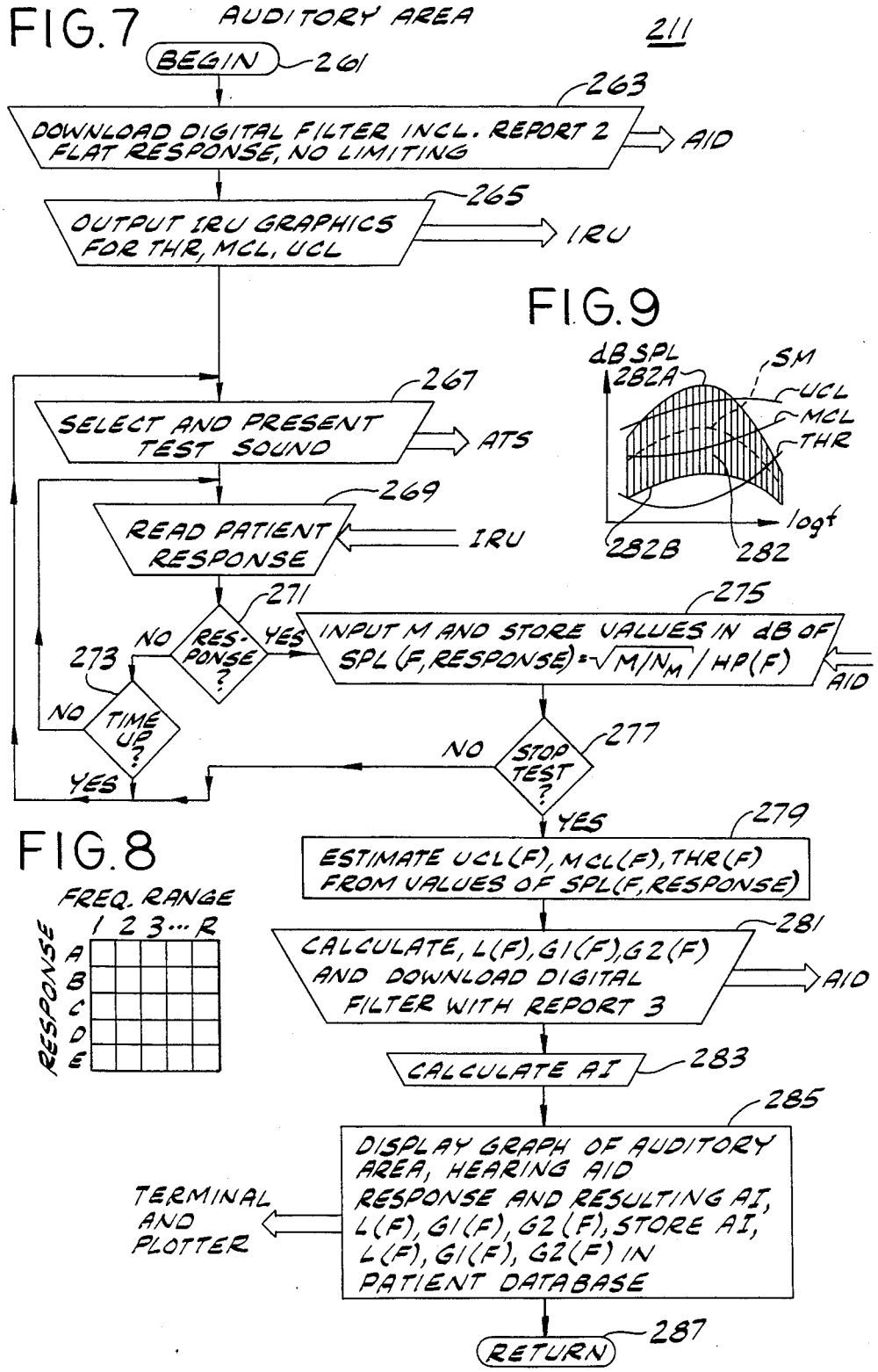
FIG. 7 is a flow diagram of operations of the host computer according to a method of the invention to measure auditory area (residual hearing) of the patient and calculate filter parameters for the hearing aid.
FIG. 8 is a diagram of a table set up in a memory of the host computer for organizing sound pressure level data indexed according to patient response and frequency range.
FIG. 9 is a graph of sound pressure level in decibels versus frequency, for use in predicting the performance of the hearing aid in mapping conversational speech onto the auditory area of the patient.

In FIG. 7 the auditory area routine 211 of FIG. 5 commences with BEGIN 261 and proceeds in step 263 to download a digital filter program into the hearing aid 12. The digital filter includes four frequency ranges or passbands. The gains in the frequency ranges are made equal to each other, and no limiting is introduced, which produces an overall flat frequency response over the spectrum 0–6 KHz. The digital filter has the routine called REPORT2 (FIG. 16) for sending back measurement data from the probe microphone.

In step 265, host computer 14 outputs patient response graphics indicating different areas of the touch sensitive screen of IRU 46 which can be touched by the patient in response to the test sounds. The response choices shown on the screen are:

A. TOO LOUD
B. LOUD
C. GOOD
D. SOFT
E. BARELY AUDIBLE.

The patient is asked to listen for test sounds and when one is heard, to touch the screen of the IRU 46 to indicate the response chosen. In step 267, host computer 14 causes ATS 36 to produce a selected test sound in a series of sounds varying in loudness and frequency. The sounds can be produced through the hearing aid 12 itself as in FIG. 6, but it is believed to be preferable to use ATS 36 for auditory area measurements so that head diffraction and other effects associated with actual use of the hearing aid are present. At step 269, the IRU 46 is accessed for the patient response, and in step 271 the host computer checks to determine whether a response has been received. If not, a branch is made to step 273 where a timer is checked, and if a preset interval has not yet elapsed, a branch is made from step 273 to step 269 whence the IRU 46 is accessed again. If there is no response, and time is up, a branch is made from step 273 to step 267 so that a different amplitude or frequency or both are selected and a new test signal is presented. When and if there is a response during the preset interval, a branch is made from step 271 to step 275 to receive sum-of-squares value M from hearing aid 12.

In performing either the pair of steps 263 and 267, or the pair of steps 231 and 233 of FIG. 6, the electronic circuitry in the aid is caused to act as programmable digital filter means for programmably producing perturbations having a controlled electrical parameter (e.g., amplitude A) in response to a first set of externally supplied signals from the host computer (e.g., filter program), the sound emitted by the receiver having a controlled parameter (e.g., sound pressure level) corresponding to the controlled electrical parameter of the perturbations. "Perturbations" is a general term which includes waveforms generally, such as sine waves, noise, and speech waveforms.

In step 275, host computer 14 indexes and stores the latest information received from the hearing aid and from IRU 46 in a sound pressure level table SPL. The SPL table is indexed as illustrated in FIG. 8 according to the five responses A, B, C, D, and E and according to frequency in a discrete number R of frequency ranges which can be in general more numerous than the digital filter ranges FO. Each cell in the SPL table represents a set of memory locations for holding respective sound pressure level data in the ear which was measured in the same frequency range and received the same patient response.

Each calculated value of SPL is initially computed as the ratio $\sqrt{M/N_M}$/HP(F) as discussed in connection with step 237 of FIG. 6. By contrast with step 237, however, the calculated value is then converted to decibels by computing the common logarithm multiplied by 20. In a further contrast, each decibel value of SPL is stored in the table which is indexed according to patient response A–E, as well as frequency range F.

In step 277, a branch is made back to step 267 to present the next test sound by means of ATS 36 unless sufficient data has been gathered, whence the test is terminated and operations proceed to step 279.

In step 279, host computer 14 calculates values, in each of the frequency ranges (equal in number to R), of uncomfortable loudness level (UCL(F)), most comfortable loudness level (MCL(F)) and hearing threshold (THR(F)) using the decibel data stored in the SPL table. UCL(F) represents the level in each frequency range where sounds make the transition from being loud (response B) to too loud (response A). UCL(F) is computed in one simple procedure by simply sorting to obtain the smallest SPL value in the A cell in each frequency range. In an alternative and more complex procedure the values in the loud and too loud categories A and B are compared to estimate where loud leaves off and too loud begins.

Most comfortable loudness level MCL(F) is computed for instance by taking the arithmetic average, or mean, of the values in each cell corresponding to response C (GOOD) in each frequency range. Hearing threshold THR(F) is computed by computing the arithmetic average, or mean, of the values in each cell corresponding to response E (BARELY AUDIBLE) in each frequency range. Even when data in response categories B and D are not used in the calculations, the provision of categories B and D causes the patient to more effectively define which data belong in categories A, C, and E.

As shown in FIG. 9, the computation of UCL(F), MCL(F), and THR(F) delineates the auditory area of the patient in SPL in dB versus log frequency. Next, it is desired to fit a known spectrum of conversational speech to the auditory area so that the patient's hearing deficiency can be fully compensated or at least ameliorated. In step 281, digital filter parameters of gain G1(F) and G2(F) and limiting L(F) are computed to accomplish the desired fit. The resulting digital filter (FIG. 17) is downloaded to the hearing aid 12 with a reporting routine REPORT3 (FIG. 18) including a self-adjusting gain feature. In performing steps 269, 275, 279, and 281, host computer 14 obtains data representing the responses of the patient from the sensing means (e.g., IRU 46) and utilizes the response data in determining the second set of signals (e.g., digital filter to download).

The operations accomplished in step 281 utilize available experimental data on conversational speech. Conversational speech has been analyzed and found to have a mean value in decibels (here designated SM(F)) which varies with frequency. Most of the loudness variation, suggested by shaded area 282 of FIG. 9, in conversational speech is bounded by a curve 282A which is 12 dB above SM(F) and a curve 282B which is 18 dB below SM(F). To fit the speech to the auditory area of the patient, the gain of hearing aid 12 is set as a function of frequency to translate SM(F) to the most comfortable loudness level MCL(F). The digital filter in hearing aid 12 is provided with an initial gain G1(F)(dB) followed by limiting to a level L(F) (dB) followed by post-filtering gain G2(F)(dB).

In order to effectively utilize the dynamic range of the digital system consisting of the ADC 111, DSP 113 and DAC 119 the values of the initial and postfiltering gains G1(F) and G2(F) are calculated to ensure that the limit value L(F) is conveniently equal to the largest number that can be produced by DSP 113 (7FFF in hexadecimal form is the largest positive number expressible in fixed point form by a 16-bit computer). By setting L(F) to this constant where $$L(F)=2^{B-1}-1 \tag{7}$$

for a B-bit representation, the RMS values of the limited signals L(F) are all equal to L(F)(dB)−3 dB where the quantity 3 dB is subtracted to adjust from the peak value L(F) to the RMS for a sine wave.

Now the gain parameter G2(F) can be calculated. G2(F) is set so that a limiter output of L(F)(dB)−3 dB will produce an SPL in the ear equal to the UCL(F). The signal path from the output of the limiter to the ear includes G2(F), SC(F) and HR(F). Hence $$G2(F)(\text{dB})=UCL(F)(\text{dB})-[L(F)(\text{dB})-3\ \text{dB}]-SC(F)(\text{dB})-HR(F)(\text{dB}) \tag{8}$$

Equation (8) states that the postlimiting gain in dB is the difference between the patient's UCL curve and the limiting level for hearing aid 12. If the limiting level exceeds the UCL, then the postlimiting "gain" in dB is an attenuation.

It remains to obtain gain G1(F). As discussed above, the intelligibility of speech is most likely to be maximized, to the extent that a priori calculations can do so, by also translating the average level of conversational speech SM(F) to the patient's most comfortable loudness level MCL(F). The average level SM(F) over the frequency spectrum is obtained from experimental analysis results such as those reported in "Statistical Measurements on Conversational Speech" by H. K. Dunn et al., *J. Acoustical Soc. of America,* Vol. 11, Jan. 1940, pp. 278–288. Since the most comfortable loudness level is below the UCL, the hearing aid output for MCL is below the limiting level L(F)(dB). Without the limiting, the hearing aid gain is G1(F)(dB)+G2(F)(dB).

The just-stated hearing aid gain is made equal to the difference of MCL(F)(dB) less SM(F)(dB) corrected for the transfer function HE(F) of the channel consisting of the external microphone and the signal path through signal conditioning circuit 103, MUX 105, S/H-IN, and ADC 111. A further correction is also made for the output channel path defined by the transfer function HR(F)×SC(F). Since gain G2(F) is now calculated from Equation (8), gain G1(F) is obtained according to the formula:

$$G1(F)(\text{dB})=MCL(F)(\text{dB})-SM(F)(\text{dB})-SC(F)(\text{dB})-HR(F)(\text{dB})-HE(F)(\text{dB})-G2(F)(\text{dB}) \tag{9}$$

The digital filter in hearing aid 12 is programmed to utilize gain values in terms of voltage amplification or attenuation. Accordingly, the gain values are converted from decibels to voltage gain by the formulas:

$$G1(F)=10^{[G1(F)(dB)/20]} \tag{10A}$$

and $$G2(F)=10^{[G2(F)(dB)/20]} \tag{10B}$$

The transfer functions HE(F), HR(F), and HP(F) are also in terms of voltage amplification and are converted from dB to voltage gain by:

$$HE(F)=10^{[HE(F)(dB)/20]} \tag{11A}$$

$$HR(F)=10^{[HR(F)(dB)/20]} \quad (11B)$$

$$SC(F)=10^{[SC(F)(dB)/20]} \quad (11C)$$

and $$HP(F)=10^{[HP(F)(dB)/20]} \quad (11D)$$

In step 283, a standard quantity called the "Articulation Index" (AI) is calculated so as to predict the quality of fit of the fitted hearing aid. Articulation Index is defined by ANSI Standard S3.5-1969 "American National Standard Methods for the Calculation of the Articulation Index." Calculations according to the standard are programmed into the host computer 14 and executed as step 283 utilizing the auditory area information obtained in testing the patient.

In step 285 of FIG. 7 host computer 14 accomplishes display and recordkeeping functions associated with the measurement of the auditory area of the patient and the automatic calculation of filter parameters for hearing aid 12. A graph of the auditory area with a spectrum of conversational speech fitted thereon (corresponding to FIG. 9) is displayed on the terminal 16 and, if elected by operator, put in hard copy form by means of printer-plotter 30. The display or printout also lists parameters of the hearing aid fitted to the patient, such as the product of HR(F)×SC(F), the noise output of the hearing aid when no external sound occurs, and the articulation index AI. AI, limit function L(F), and gains G1(F) and G2(F) are stored in the patient data base along with the data entered in patient interview step 207 of FIG. 5, whence RETURN 287 is reached.

Figure 10:
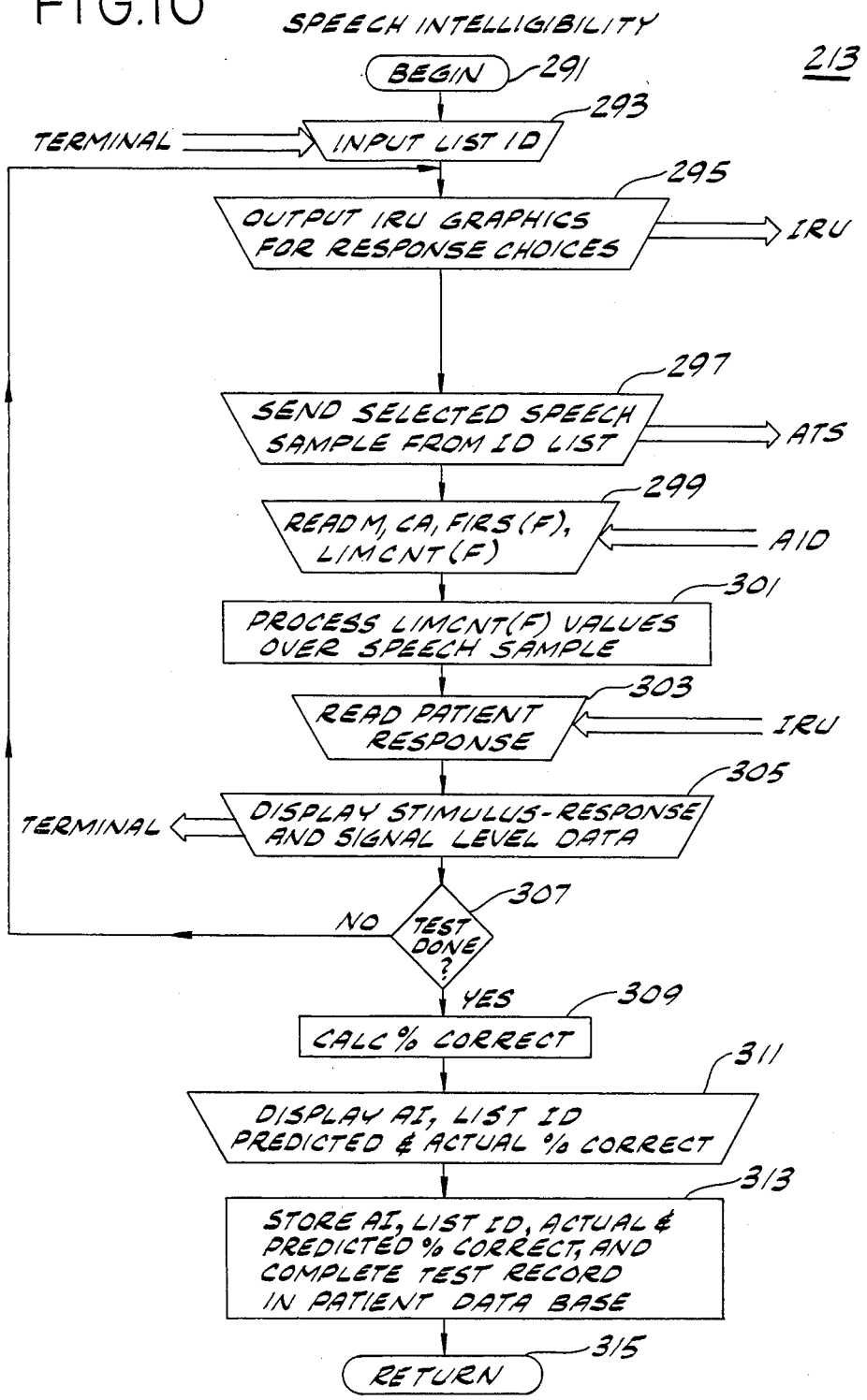
FIG. 10 is a flow diagram of operations of the host computer according to a method of the invention to monitor the operation of a hearing aid of the invention on the patient and to measure the resulting intelligibility of speech to the patient.

FIG. 10 shows a flow diagram of operations for the speech intelligibility test operations of host computer 14. After BEGIN 291, an identification number ID of a list of test words is input in step 293 from the terminal 16. At step 295, graphics for multiple choice word recognition responses by patient are output to IRU 46. In step 297, host computer 14 causes ATS 36 to play the next one of the test words on the list for the patient with hearing aid 12 to listen to. Host computer 14 in step 299 reads values reported back from the hearing aid by the REPORT3 routine. The data values include a constant CA, which is nominally 1.0, the changes in which indicate changes in ear impedance. A set of data values called FIRS(F) is a sum-of-squares output of DSP 113 for each of the four frequency ranges of the digital filter. Another set of data values called LIMCNT(F) indicates how many times the speech waveform actually exceeded the limit function L(F) in the digital filter.

In step 301, it is recognized that the LIMCNT(F) values are being generated as each speech sample is actually being played. Accordingly, values of LIMCNT(F) are summed or otherwise processed over the entire speech sample so that a total value indicating the amount of limiting on each sample can be derived. In this way, the performance of the hearing aid for particular words or other sounds can be observed and subsequent fine adjustments facilitated.

In step 303, the patient response to the multiple choice question on the IRU 46 is received from the IRU. The data gathered from the hearing aid in step 299 and from the IRU in step 303 are displayed to the operator on the terminal 16 in step 305. If it is desired to play more speech samples, a branch is made from step 307 back to step 295 to continue the test. If the test is done, then operations proceed to step 309 to calculate the percent of the words which the patient correctly recognized.

In step 311, the operator compares the articulation index calculated for the hearing aid with the list ID, and compares the predicted percent of correct answers based on AI with the actual percent correct. At step 313, the values displayed in step 311 are stored in the patient data base with a complete record of the responses of the patient to each question in the test, whence RETURN 315 is reached.

Figure 11:
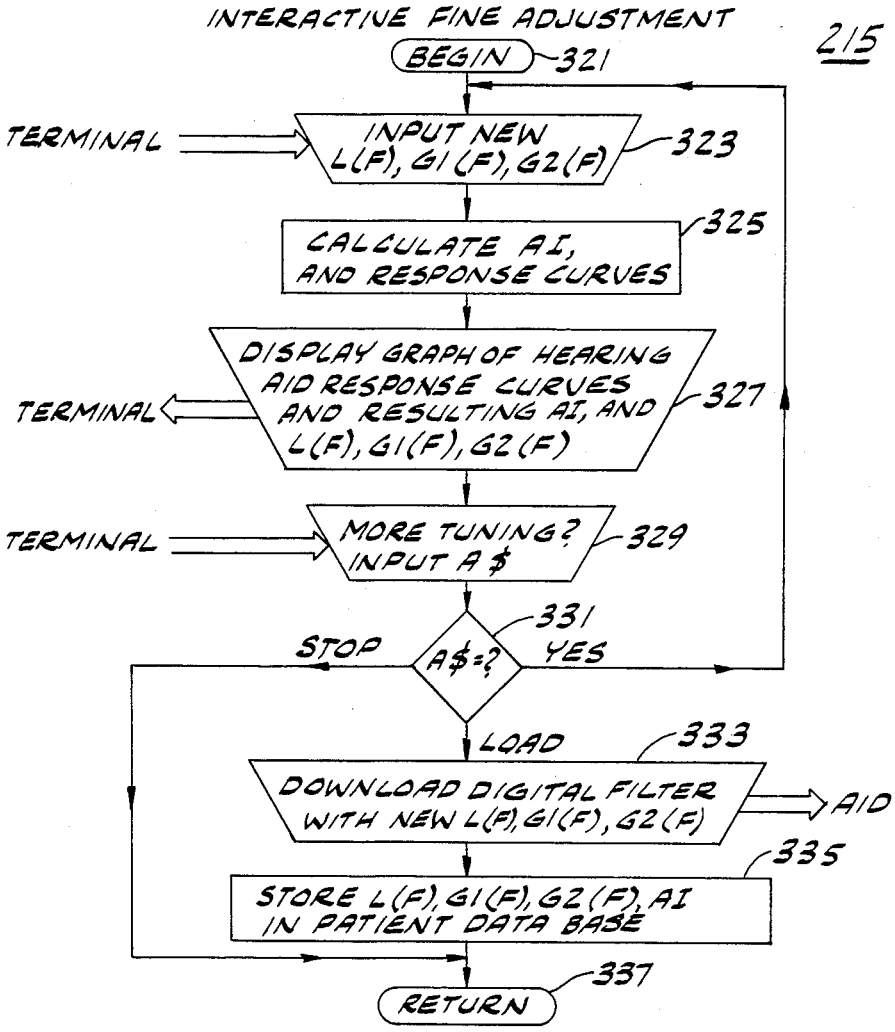
FIG. 11 is a flow diagram of operations of the host computer according to a method of the invention for interactive, or adaptive, fine adjustment of the performance of a hearing aid of the invention.

In a further set of advantageous operations shown in FIG. 11, the operator of terminal 16 can adjust the filter parameters programmed into the hearing aid 12 and calculate a predicted performance of the hearing aid before deciding whether or not to download the adjusted filter parameters. Operations commence at BEGIN 321 and proceed to step 323 where the operator enters one or more adjusted values of limit function L(F) and gains G1(F) and G2(F) from terminal 16. In step 325, host computer 14 computes how the hearing aid would, if programmed with the adjusted values, reposition the conversational speech spectrum 282 (FIG. 9) on the stationary auditory area defined by the previously measured UCL(F), MCL(F), and THR(F) curves. The articulation index is calculated according to the above-cited ANSI standard from the foregoing information in step 325. Then an informational display is fed to terminal 16 showing the auditory area with the repositioned conversational speech spectrum (hearing aid response curves), and the value of the resulting AI. All of the adjusted and unadjusted values of L(F), G1(F), and G2(F) are also output for operator reference.

At step 329, host computer 14 asks the operator through terminal 16 for instructions. Operator inputs a string designated A$. If A$ is "YES," operations branch back from step 331 to step 323 and repeat steps 323 through 329 so that the operator can further adjust values in an interactive procedure in which the operator homes in on final filter parameters for the hearing aid. If A$ is "LOAD," operator is telling host computer 14 to proceed to step 333 to download adjusted filter parameters to hearing aid 12 thus changing the operation of the hearing aid itself to correspond to the parameters adjusted by the operator. After step 333, the computer 14 in step 335 stores the adjusted filter parameters together with the most recently calculated value of AI in the patient data base so that there is a record of this deliberate change to the hearing aid. If in step 331, the string A$ is "STOP," then the hearing aid is not changed, and RETURN 337 is reached.

Thus, host computer 14 with its terminal 16 also graphically displays hearing threshold, most comfortable loudness level, uncomfortable loudness level, and performance characteristics of the hearing aid (e.g., in mapping conversational speech onto the auditory area), and generates a third set of signals (e.g., downloads an adjusted filter) determined by interaction with an operator for establishing adjusted filter parameters in the programmable filtering means.

Figure 12:
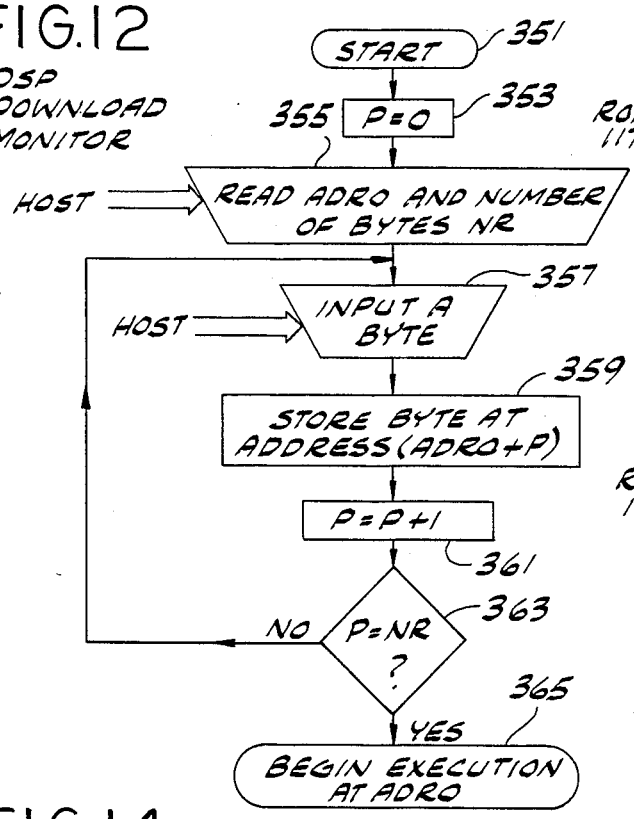
FIG. 12 is a flow diagram of operations of a hearing aid according to the invention for loading and executing entire programs.
Figure 13:
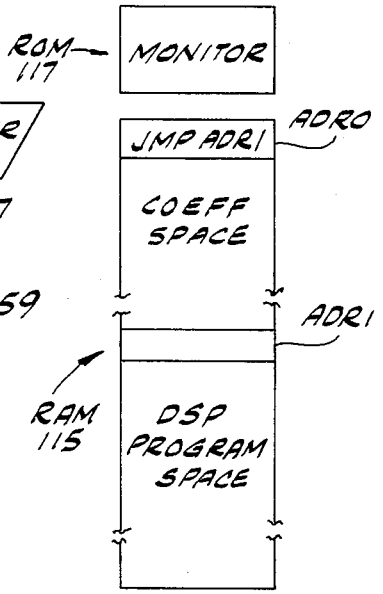
FIG. 13 is a map of memory space in a hearing aid according to the invention.

DSP 113 loads and executes entire programs supplied to it by host computer 14. FIG. 12 shows the download monitor in DSP 113, "monitor" having its computer meaning of a sequence of operations that supervise other operations of the computer. FIG. 13 illustrates that the monitor is stored in ROM 117 and a program having been downloaded is stored in RAM 115 beginning at an address ADR0, typically followed by data, or coefficient space, followed by first executable contents at an address ADR1 and the rest of the program in an area designated DSP Program Space.

The monitor of FIG. 12 is programmed as an interrupt routine which commences at START 351, regardless of any other program which may be previously running, whenever the interrupt line INT is activated in FIG. 4. An index P is initialized to zero in step 353. The monitor receives supervisory information from the host computer 14 through serial interface 151 in step 355. The supervisory information is the numerical value of the address to be used as ADR0, and the number of bytes NR to be downloaded.

At step 357, DSP 113 inputs a byte of the program and in step 359 stores that byte at a RAM address having the value equal to the sum of the value of ADR0 plus the value of the index P. Since P is initially zero, the first program byte is stored at address ADR0. At step 361, index P is incremented by one. Until P becomes equal to the number of bytes NR, a branch is made at step 363 back to step 357 to execute steps 357 through 361 again, thereby loading the entire program being received from the host computer 14. When P is the same as NR, step 365 is reached whence DSP 113 jumps to ADR0 and begins executing the entire downloaded program beginning with the contents of address ADR0.

The monitor of FIG. 12 is uncomplicated and short, which reduces the cost of programming ROM 117 at the factory. The monitor is flexible in that it can be used to load a long program into RAM and then subsequently write over a portion such as the coefficient space, to change the parameters utilized by the long program. Beginning address ADR0 can hold a "jump" instruction to a different redefinable address ADR1, adding further flexibility to the software. Because the address ADR0 is defined by the host computer and can be redefined, another program can be subsequently loaded starting at a different value of ADRO without having to reload a previously loaded program. Accordingly, improvements in hearing aid 12 can be accomplished by reprogramming from new editions of software supplied for the host computer 14, thereby avoiding burdening patients with the expense of a new hearing aid 12 itself.

Figure 14:
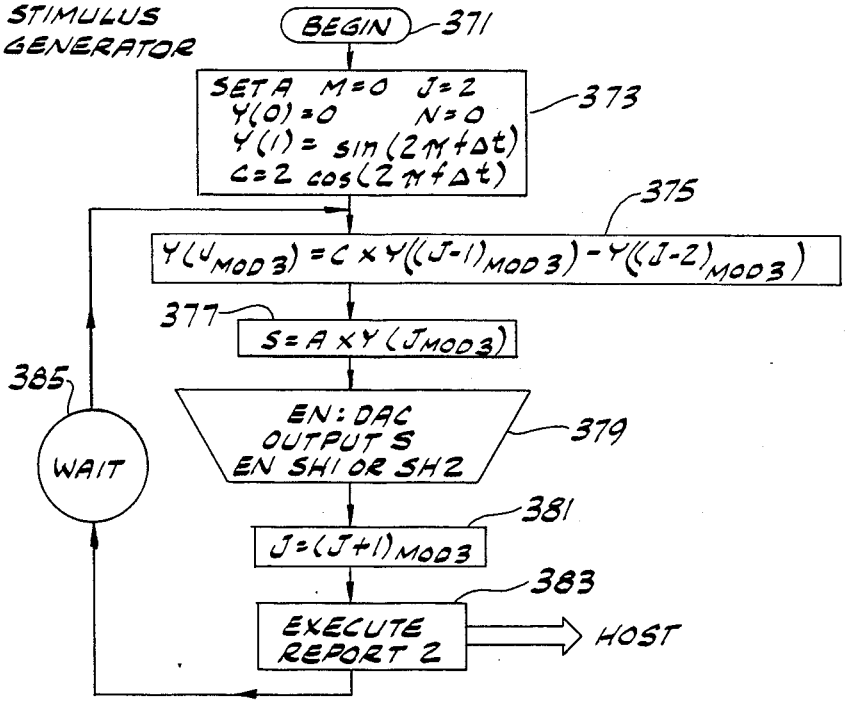
FIG. 14 is a flow diagram of operations of a hearing aid according to the invention for self-generating an output to cause test sounds to be emitted from the hearing aid into the ear of the patient.

FIG. 14 shows a stimulus generator routine downloaded into RAM 115 by means of the DSP 113 monitor of FIG. 12 and in response to the host computer step 231 of FIG. 6. The stimulus generator is a set of DSP 113 operations for driving the receiver of the hearing aid in a self-generating mode activated by the signals which downloaded the stimulus generator. The stimulus generator routine essentially turns DSP 113 into an oscillator and a system for reporting back the output of the probe microphone 77.

Operations commence at BEGIN 371. A set of variables J, N, and C are initialized at step 373 in which J is set to 2, N is set to 0, and C is set equal to a number precalculated in the host computer as $2\cos(2\times pi\times f\times delta\text{-}t)$. "pi" is 3.1416, the circumference of a circle divided by its diameter. "f" is the frequency of oscillation in Hertz (Hz.) selected by host computer 14. "delta-t" is a time interval between values generated by the stimulus generator. An amplitude parameter A is set to a value selected by the host computer. A table Y is indexed according to the variable J. Variable J is permitted to take on only three values 0, 1, and 2. Entry Y(0) is initialized to zero, and Y(1) is initialized to a number calculated in the host computer as $\sin(2\times pi\times f\times delta\text{-}t)$. A sum-of-squares accumulator M is initialized to zero.

Figure 17:
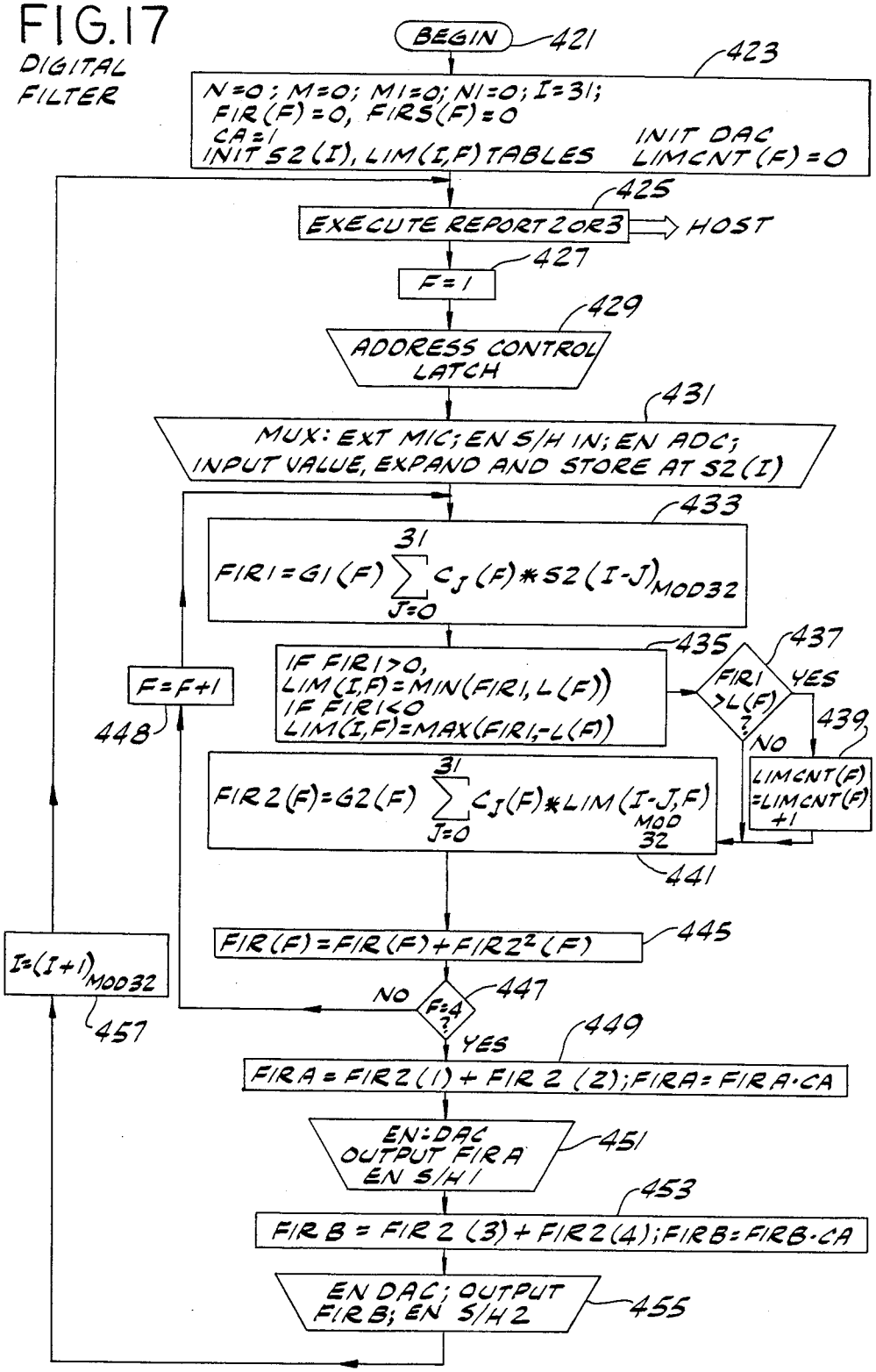
FIG. 17 is a flow diagram of operations of a hearing aid according to the invention for implementing a self-adjusting filter-limit-filter digital filter.

In the discussion of FIGS. 14 and 17 that follows, modulo notation is used for brevity. 0 modulo 3 is 0; 1 modulo 3 is 1, 2 modulo 3 is 2; 3 modulo 3 is 0, −1 modulo 3 is 2; −2 modulo 3 is 1, and −3 modulo 3 is 0. In general, X modulo B is X when X is greater than or equal to 0 and less than B. When X is greater than or equal to B, X modulo B is X−B for X less than 2B−1. When X is less than zero, X modulo B is X+B for X greater than −B−1. Modulo notation is useful in showing that only B memory locations in a computer are needed in a process that is progressing through memory locations indefinitely.

In step 375 of FIG. 14 an output value of a sine wave of amplitude 1 (RMS value of 0.707) is generated by calculating a value for the latest table entry $Y(J_{mod\ 3})$ in sequence as C times the next previous entry $Y((J-1)_{mod\ 3})$ less the entry $Y((J-2)_{mod\ 3})$. At step 377, the output of the stimulus generator is scaled up from the sine wave of amplitude 1 to produce an output value S by multiplying entry $Y(J_{mod\ 3})$ by the amplitude parameter A.

At step 379, DAC 119 of FIG. 4 is enabled by DSP 113, and the value of S is output in digital form from DSP 113 to DAC 119. DAC 119, of course, converts the value of S to analog form. Then DSP 113 enables one and not the other of sample-and-hold circuits 133 and 135 so that the analog output is fed to one and not the other of woofer 79 and tweeter 81. Step 379 is programmed to enable the correct sample-and-hold circuit depending on the frequency f of the test sound being generated. Such programming is readily accomplished because frequency f is known a priori by host computer 14 when the stimulus generator is downloaded for each test sound to be generated.

At step 381, index J is incremented by one, modulo 3, to the value $(J+1)_{mod\ 3}$. At step 383, the report routine REPORT2 is executed, sending back sum-of-squares information gathered by probe microphone 77 to host computer 14. Depending on the speed of DSP 113 a preestablished waiting period is programmed at step 385, so that when the operations proceed back to step 375 to execute steps 375–383 again, the frequency of the generated sound is at the predetermined frequency f. It is to be understood that even though stimulus generator is an endless loop with no RETURN or END, its operations are interrupted and the monitor resumed simply by host computer 14 sending a character to interrupt DSP 113 and load the stimulus generator routine with different frequency f, amplitude A, and designation of SH1 or SH2.

Figure 15:
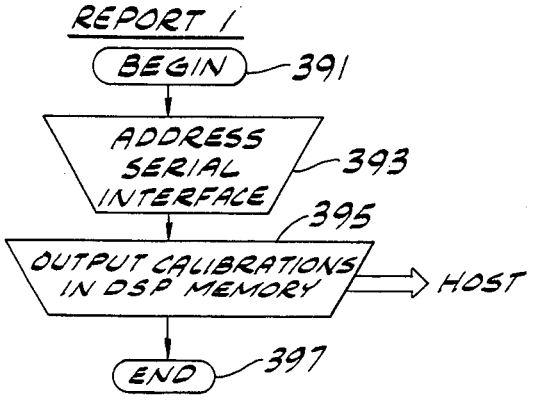
FIG. 15 is a flow diagram of operations of a hearing aid according to the invention for reporting prestored calibrations to the host computer.

A brief digression is made to describe the REPORT1 routine of FIG. 15. REPORT1 is downloaded from host computer 14 to DSP 113 in step 227 of FIG. 6. Its purpose is to obtain the transfer functions HE(F), HR(F) and HP(F) which amount to hearing aid calibration data and are prestored in the memory of the hearing aid during manufacture. When the monitor reaches step 365 of FIG. 12 after downloading REPORT1, it jumps to BEGIN 391. REPORT1 proceeds to address, or enable, the serial interface 151 at step 393. Next in step 395, the values of HE(F), HP(F) and HR(F) for each value of F are fetched from predetermined memory locations and transmitted through serial interface 151 to host computer 14, whence END 397 is reached. In this way host computer 14, which is a means for supplying REPORT1, also retrieves the calibration data from the hearing aid memory and utilizes the calibration data and a subsequently-obtained parameter of the probe microphone output in determining and supplying the second set of digital signals (e.g., a digital filter program).

Figure 16:
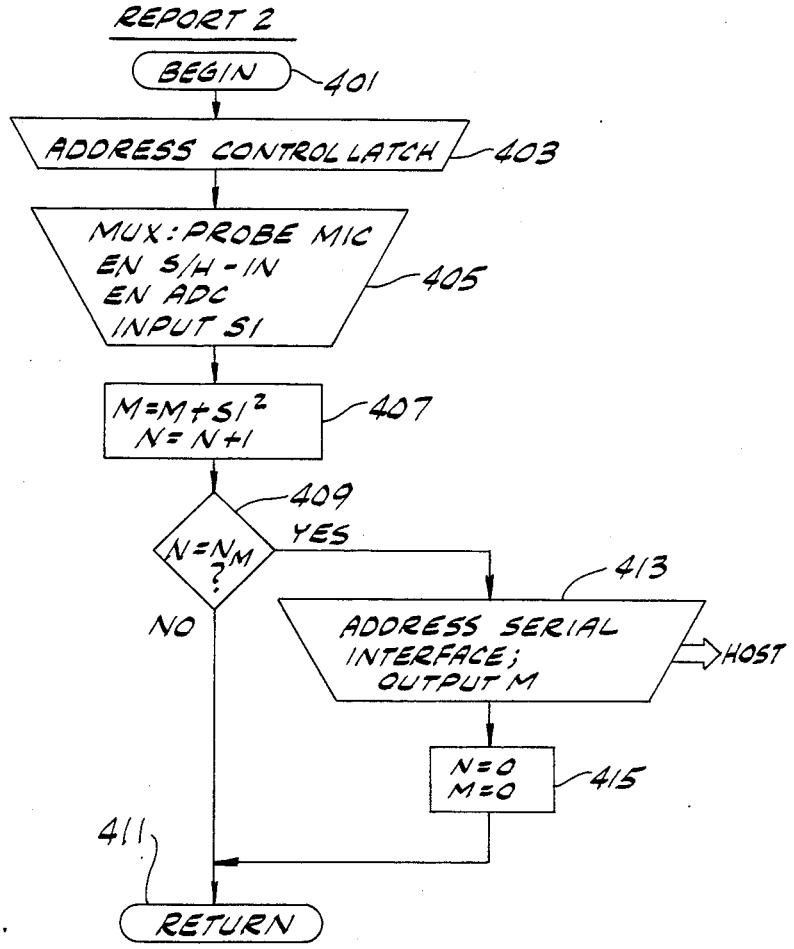
FIG. 16 is a flow diagram of operations of a hearing aid according to the invention for supplying the host computer with data for use in determining the sound pressure level in the ear canal.

The routine designated REPORT2 of FIG. 16 is incorporated as a subroutine in a downloaded program such as the stimulus generator of FIG. 14 or the digital filter described hereinafter in connection with FIG. 17. For example, in the stimulus generator when step 381 is completed, operations proceed to BEGIN 401 of REPORT2 of FIG. 16. In step 403 of REPORT2, the control latch 127 of FIG. 4 is addressed, or enabled. In step 405 a sequence of bytes is supplied from port P1 of DSP 113 to control latch 127, which successively selects the probe microphone line 141 at MUX 105, enables S/H-IN 109, then enables ADC 111, and finally senses a digital representation S1 of the conditioned instantaneous voltage from the probe microphone.

In step 407 the S1 value is squared and added to accumulator variable M. Index N of step 373 is incremented by 1. At step 409, N is tested to determine if it has reached $N_M$ yet. If not, RETURN 411 is reached and no communication to host computer 14 occurs yet. However, after $N_M$ repetitions of REPORT2, a branch is made from step 409 to step 413 at which the serial interface 151 is addressed and the value of M is output to the host computer 14.

It should be understood that M is a sum-of-squares and not a root-mean-square value. This, however, is no problem, since the $N=N_M$ test at step 409 is known, and the relatively time-consuming operations of division by $N_M$ and taking the square root of the result to obtain the actual root-mean-square can be accomplished by host computer 14 (steps 237 and 275) where computer burden is not as important as in DSP 113. The signal for M thus represents a mean-square sound pressure parameter (e.g., square of SPL) by being proportional thereto. After the value of M has been reported, index N and accumulator variable M are reset to zero at step 415.

It is noted that the reference value $N_M$ is a prestored value which is set at 400 or to any other appropriate value selected by the skilled worker. It is intended that the sum-of-squares is to be accumulated in an appropriate and effective manner to permit host computer 14 to obtain or derive an RMS value for the probe channel which can be used to accurately calculate sound pressure level SPL. Thus, errors resulting from summing over only parts of cycles rather than whole cycles should be avoided in programming the report routine and host computer 14.

In this way the circuitry of FIG. 4 in performing the operations described in FIG. 16 constitutes means coupled to the second (probe) microphone for also supplying a signal (e.g., M) for external utilization, the signal representing a mean-square sound pressure parameter of the sound.

A flowchart of the digital filter routine for DSP 113 is shown in FIG. 17. When the monitor of FIG. 12 has loaded the digital filter in response to step 263, 281, or 333 in the host computer, and completed step 363, operations commence at BEGIN 421 and proceed to initialization step 423. Indices N and N1 are set to zero, accumulator variables M and M1 are set to zero, index I is set to 31, and a constant CA (calculated in operations of FIG. 18) is set to one. A 32 element table S2(I) has all elements set to zero; and a triplet of four-element output tables FIR(F), FIRS(F), and LIMCNT(F) indexed by frequency range F respectively have all elements set to zero. A 4-row, 32-column table LIM(I,F) is initialized to zero. DAC 119 is initialized to zero to avoid a transient in the receiver.

At step 425, REPORT2 (FIG. 16) is executed when the digital filter is downloaded by step 263 of FIG. 7. Otherwise REPORT3 (FIG. 18) is executed as a result of download step 281 or 333. At step 427, the frequency range index F is initialized to 1, and a gain adjustment constant CA1 is derived as an approximation to the reciprocal of the square root of constant CA. (See discussion of REPORT3 for theory of CA1.). The control latch 127 is enabled in step 429. Step 431 represents a sequence of operations for bringing in a sample from the external microphone 75. Bytes supplied from port P1 enable MUX 105 for the external microphone, then S/H-IN 109, then ADC 111, and finally sense a digital value. The digital value is expanded, to offset the compression in signal conditioning circuit 103, by applying an expansion formula or by table lookup. The expanded value is then stored in location I of table S2.

The first gain step 433 of the digital filter is executed according to a finite impulse response routine expressed as $$FIR1 = G1(F) \times \underset{J=0}{\overset{31}{\text{SUM}}} [C_J(F) \times S2((I - J)_{mod\ 32})] \tag{12}$$

The equation (12) of step 433 states that a linear combination is formed by 32 prestored coefficients $C_J(F)$ with the 32 entries of the S2 table working backward modulo 32 in table S2 from the latest entry I. The linear combination, also called convolution in the art, herein labeled as SUM, is multiplied by a voltage gain G1(F) to produce the first output FIR1 ready for limiting, if limiting be necessary. FIR1 is merely a single word in the computer since it is computed and used immediately.

In step 435 limiting is performed so that the table LIM(I,F) is updated to have an entry at index I and frequency range F set equal to the lesser of FIR1 or L(F) when FIR1 is positive. LIM(I,F) is set equal to the greater of FIR1 or the negative of L(F) when FIR1 is negative. Thus, when limiting occurs, step 435 "clips" both the positive and negative peaks of the waveform presented to it. L(F) is simply the highest value, for example, of a word in DSP 113 (+7FFF for a 16-bit computer) or some other preselected binary value.

In step 437, a check is made to determine whether limiting took place, by comparing FIR1 with L(F). If FIR1 was excessive, then limiting-counter table LIMCNT(F) has the element for frequency range F incremented by one in step 439. Otherwise operations proceed directly to step 441.

At step 441 postlimiting filtering is performed. This step is analogous to step 433 in that the coefficients $C_J(F)$ are the same, but now it is the output of step 435 which is being filtered according to the formula $$FIR2(F) = G2(F) \times \underset{J=0}{\overset{31}{\text{SUM}}} [C_J(F) \times \text{LIM}((I - J)_{mod\ 32}),F)] \tag{13}$$

where G2(F) is the postlimiting gain in frequency range F, and LIM is the $4 \times 32$ table for holding the output of step 435.

DSP 113 in performing steps 433, 435, and 441 constitutes programmable digital filter means for utilizing the filter parameters established by the second set of externally supplied signals (e.g., those downloading the filter) to establish the maximum power output of the hearing aid as a function of frequency. DSP 113 in performing steps 437 and 439 is caused to also supply or generate a signal for external use in adjusting the performance of the hearing aid, the last-said signal representing the number of times as a function of frequency that the established maximum power output of the hearing aid occurs in a predetermined period. There is a predetermined period because the accumulated values in LIMCNT(F) are reported every $N_M$ loops (see FIG. 18).

4-element table FIR2(F) has the element for frequency range F updated by the computation of Equation (13). Table FIR2(F) is a storage area so that after all of the frequency ranges have been processed, the values in the FIR2(F) table can be used almost simultaneously.

Next at step 445 a table FIR(F) accumulates the sum-of-squares of FIR2(F) in each frequency range F for use in connection with the self-adjusting feature hereinafter described.

A test at step 447 determines whether all of the frequency ranges have been filtered using the latest sample S2(I). If F is less than 4, a branch is made to step 448 to increment F and then do filter-limit-filter digital filtering in the next higher frequency range. Finally F reaches 4, and at step 449 a section of operations commences for forming the output values to drive the woofer and tweeter respectively.

For purposes of determining the digital filter characteristics (in-band ripple and out-of-band rejection), the two steps 433 and 441 executed in any one frequency range F are regarded as being the digital versions of two corresponding analog filters. The two corresponding analog filters are separate but illustratively identical analog filters having four analog filter sections each. Each of the four analog filter sections is defined by three specifying data: a tuning frequency, a quality factor Q, and a gain $A_o$, which are set forth as headings in Table II. Since there are four frequency bands or ranges F=1, 2, 3, 4, in this preferred embodiment, Table II shows values of the three specifying data for each of the four analog filter sections in each of the four frequency bands (a total of 16 analog filter sections).

TABLE II

| | Band Edges (Hz) | Tuning Frequency (Hz) | Q | Ao | Filter Section |
|---|---|---|---|---|---|
| Low | 240 | 435 | 2.21 | 1.5 | 1 |
| Filter | 560 | 309 | 2.21 | 1.5 | 2 |
| | | 544 | 5.67 | 1.5 | 3 |
| | | 247 | 5.67 | 1.5 | 4 |
| Low- | 627 | 1074 | 2.44 | 1.5 | 1 |
| Medium | 1353 | 790 | 2.44 | 1.5 | 2 |
| Filter | | 1318 | 6.20 | 1.5 | 3 |
| | | 644 | 6.20 | 1.5 | 4 |
| High | 1504 | 2671 | 2.29 | 1.5 | 1 |
| Medium | 3412 | 1921 | 2.29 | 1.5 | 2 |
| Filter | | 3318 | 5.86 | 1.5 | 3 |
| | | 1546 | 5.86 | 1.5 | 4 |
| High | 3755 | 4921 | 4.86 | 1.5 | 1 |
| Filter | 5545 | 4231 | 4.86 | 1.5 | 2 |
| | | 5467 | 11.9 | 1.5 | 3 |
| | | 3809 | 11.9 | 1.5 | 4 |

It should be noted that Table II defines the filters without deemphasis. When digital deemphasis is desired, the gain $A_o$ should be changed in Table II to provide the deemphasis. Otherwise, it is assumed that when preemphasis is provided by signal conditioning circuit 103, corresponding deemphasis is supplied by AAFs 133 and 135 of FIG. 4.

The coefficients $C_J(F)$ are precalculated and prestored in the host computer 14 for each frequency range F to implement in digital form the characteristics called for in Table II. It is to be understood that there are 32 coefficients $C_0$, $c_1$, . . . , $C_{31}$ for each frequency range F=1, 2, 3, and 4. Consequently, there are a total of 128 (32×4) prestored $C_J(F)$ coefficients in the preferred embodiment example of FIG. 17. The coefficients used in step 433 are identical to those used in step 441 in this example. The procedure for precalculating the coefficients is known to those skilled in the art and is disclosed for instance in "A Computer Program for Designing Optimum FIR Linear Phase Digital Filters" by J. H. McClellan et al., *IEEE Transactions on Audio and Electroacoustics,* Vol. AU-21, No. 6, Dec., 1973, pp. 506–526.

In step 449, a DSP 113 output FIRA for the woofer channel is formed as the product of gain adjustment constant CA1 with the sum of the digital filter outputs FIR2(1) and FIR2(2) in the two lower frequency ranges, where F=1 and 2. At step 451 the woofer is fed the latest output value FIRA by enabling the DAC 119, sending FIRA to the DAC 119 from DSP 113, and then enabling S/H1 to convert FIRA to analog form to drive the woofer. Steps 453 and 455 are analogous to steps 449 and 451. In step 453 a DSP 113 output FIRB for the tweeter channel is formed as the product of the gain adjustment constant CA1 with the sum of the digital filter outputs FIR2(3) and FIR2(4) in the two higher frequency ranges, where F=3 and 4. At step 455, the tweeter is fed the latest output value FIRB by enabling the DAC 119, sending FIRB to the DAC 119 from DSP 113, and then enabling S/H2 to convert FIRB to analog form to drive the tweeter.

At step 457, index I is incremented by one, modulo 32, and step 425 is reached. A report routine is executed and then the next sample S2(I) from the external microphone is digitally filtered. Then the woofer and tweeter are driven, and so on repeatedly in an endless loop which is only terminated by interrupting DSP 113. The endless loop is the continuous operation of hearing aid 12 in assisting the patient to hear.

In connection with the operations of FIG. 17, advantageous techniques of digital signal processing are employed to reduce the processing load on DSP 113 wherever possible. For example, decimation and interpolation [Crochiere, R. E. and Rabiner, L. R., Optimum FIR Digital Filter Implementation for Decimation, Interpolation, and Narrowband Filters, IEEE Trans. Acoust. Speech, and Signal Proc., Vol. ASSP-23, pp. 444–456, October, 1975] are employed before and after the filter-limit-filter channels to reduce the computational sampling rate required of the filter-limit-filter calculation.

In the context of this preferred embodiment step 431 of FIG. 17 includes a low-pass filter of 6 kHz bandwidth followed by a 4 to 1 decimation (discard 3 out of 4 samples) of sampling rate from 50 kHz to 12.5 kHz. The filter-limit-filter calculations are then carried out at the reduced 12.5 kHz rate.

Included in steps 449 and 453 of FIG. 17 and before samples are output to the DAC 119 the sampling rate is increased from 12.5 kHz to 50 kHz through a process of interpolation of 1 to 4 (inserting 3 zeros between each sample) followed by low-pass digital filter with a cutoff of 1.5 kHz for the woofer output and a digital bandpass filter with lower and upper cutoff frequencies of 1.5 kHz and 6 kHz for the tweeter output.

Figure 18:
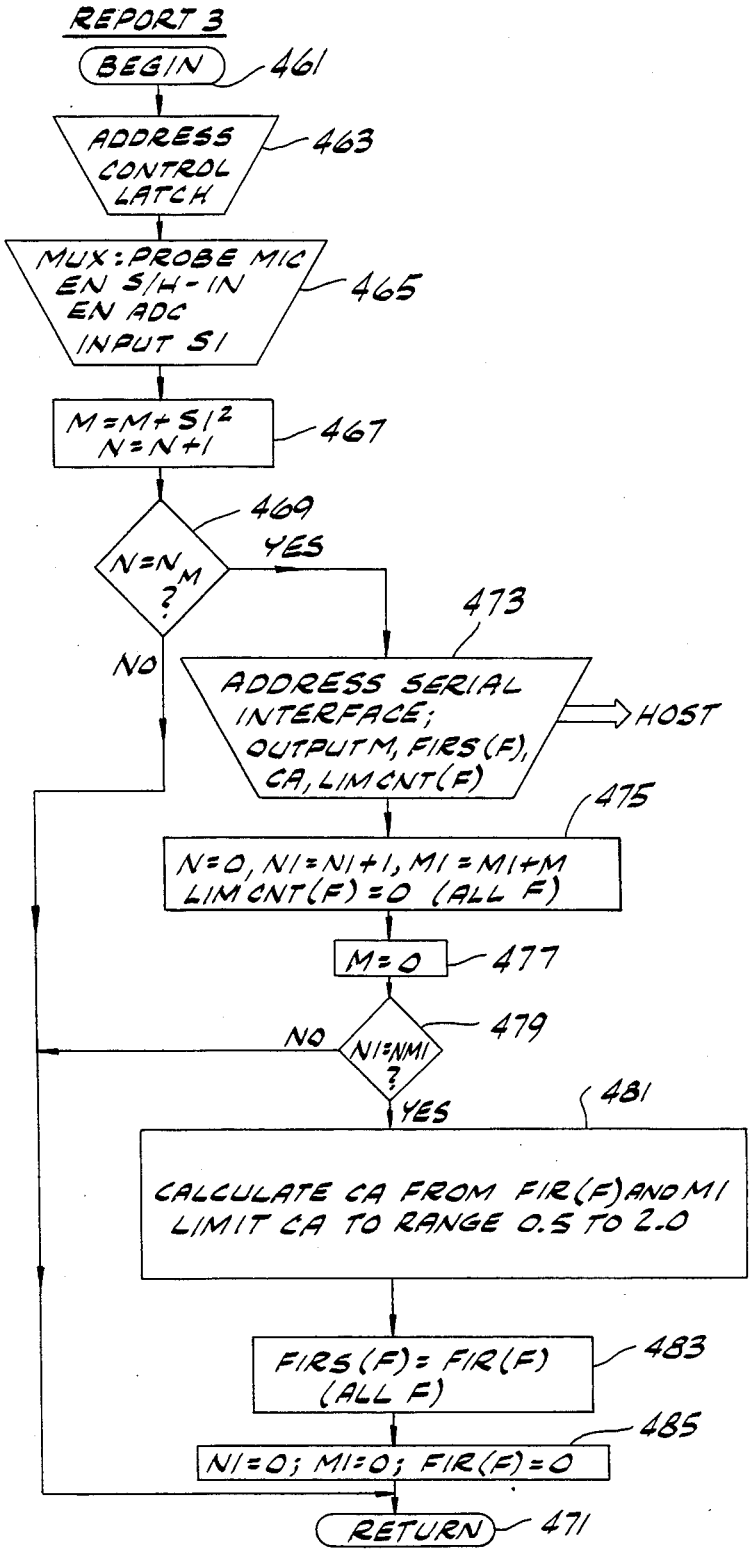
FIG. 18 is a flow diagram of operations of a hearing aid according to the invention for supplying the host computer with data for use in determining sound pressure level in the ear canal and in monitoring the self-adjusting and limiting operations of the digital filter of FIG. 17.

The reporting routine REPORT3 in FIG. 18 is similar to REPORT2 (FIG. 16) except that REPORT3 additionally calculates constant CA for use in the self-adjusting gain feature. Accordingly, steps 461, 463, 465, 467, 469 and RETURN 471 are the same in nature and purpose to REPORT2 steps 401, 403, 405, 407, 409, and RETURN 411, so that further discussion of said steps is omitted for brevity. In REPORT3, however, when N reaches $N_M$, a branch is made to a step 473. At step 473, the serial interface 151 is enabled. DSP 113 communicates the values of accumulator variable M, a sum-of-squares filter output table FIRS(F), constant CA, and limiting-counter table LIMCNT(F) to the host computer 14 (used in step 299 of FIG. 10).

Step 475 reinitializes index N to zero and LIMCNT(F) to zero for all F. However, for gain self-adjusting purposes, index N1 is now incremented by one and another accumulator variable M1 is incremented by M. Then at step 477, the first accumulator variable M is reset to zero. At step 479 a branch is made to RETURN 471 if N1 has not reached a prestored value NM1 set at 500 or any other appropriate value.

When N1 reaches NM1, which takes about 16 seconds (typically 80 microseconds×400×500), step 481 is reached, wherein a calculation for self-adjustment of gain commences. The ear impedance is a function of ear canal volume and other factors. So long as the ear impedance remains the same as it was when the procedure of FIG. 6 for calibrating was performed, the value of constant CA should be unity. Step 481 is performed after typically 200,000 ($N_M$×NM1) samples S1 from the probe channel have been squared and summed to produce the quantity M1.

The quantity M1 can be regarded as being derived from a single waveform having an 0–6KHz spectrum or from four waveforms having spectra respectively covering each of the digital filter frequency ranges. Because the four waveforms are independent of each other, the sum M1 of the squares of the single 0–6 KHz waveform is equal to the total of the sum-of-squares of each of the four waveforms if they were isolated. This relationship is expressed mathematically as $$M1 = \sum_{F=1}^{4} [FIR(F) \times HR^2(F) \times SC^2(F) \times HP^2(F)] \tag{14}$$

M1 is the sum-of-squares of 200,000 samples of the output of ADC 111 to DSP 113 in the probe channel. FIR(F) is a sum-of-squares of 200,000 values of the waveforms in the four frequency ranges computed by DSP 113 in step 445. HR(F), SC(F), and HP(F) are respectively the transfer function of the output channel, scaling constant to correct for the actual ear impedance, and the transfer function of the probe channel. They translate the waveforms in the four frequency ranges to the output of ADC 111. The right side of Equation (14) is a prediction, therefore, of what M1 will be so long as the ear impedance of the patient does not change.

If the ear impedance does change, the actual measured M1 on the left side of Equation (14) will no longer be equal to the sum on the right side. This is because scaling function SC(F) no longer describes the ear, as it has changed. Then as shown in step 481, constant CA is calculated as a function of the ratio of the right side of Equation (14) to M1.

It is noted that CA is calculated as a constant, i.e., a quantity independent of frequency, and not as a function of frequency range index F. This is because the calculation assumes that if the ear impedance does change, the correction should be equal in all frequency ranges or that such correction will cause a negligible departure from optimum fit. Moreover, the calculation of a single constant CA independent of frequency keeps computer burden low and is thus preferred. Corrections can be made which are a a function of frequency, however, and such refinements are within the scope of the invention.

Step 481 is completed by limiting CA to a preestablished range such as 0.5 to 2.0 (a±6 dB range). This is a precaution against unexpected values computed for CA which would be expected to only arise from causes other than a change in the ear impedance. Accordingly, if CA is computed to be a value in the range, that value is not modified by step 481. If CA is less than the lower limit, e.g. 0.5, then CA is set equal to the lower limit. If CA is more than, the upper limit, e.g. 2.0, then CA is set equal to the upper limit.

In the FIG. 17 flow diagram at steps 427, 449, and 453, the value of CA resulting from step 481 of FIG. 18 is used, in effect, to adjust the postlimiting gain G2(F) by multiplying it by CA which is:

$$CA = 1 + a\left[\left(\sum_{F=1}^{4} (FIR(F) \times HR^2(F) \times SC^2(F) \times HP^2(F))\right) - M1\right] \tag{15}$$

where CA is limited to the range 0.5 to 2.0 and a is chosen to control the sensitivity of CA to the difference enclosed in parenthesis. The reasoning behind the calculation of CA is based on Equations (7), (8) and (9). Constant CA is essentially a constant correction factor to SC(F) in each frequency range. Thus CA is a multiplying factor determined by a linear approximation of the difference between the predicted and measured mean-square values. Equation (15) is an approximation to the square root of the ratio of the right side of Equation 14 to measured M1.

Equation (8) establishes a criterion that UCL(F) not be exceeded by the preestablished maximum power output of the hearing aid. Gain G2 is therefore multiplied by a factor of CA, as shown in steps 449, and 453, when CA departs from unity. Equation (9) sets forth the relationship by which the speech mean SM is translated to the patient's MCL(F). Inspection of Equation (9) shows that it is also satisfied when CA departs from unity by applying CA as a factor as shown in FIG.

Thus, the electronics module 61 as a driving means responds to the second (probe) microphone for also self-adjusting the operation of the driving means in the filtering mode. The operations that produce CA in step 481 amount to comparing the output of the second microphone with the degree of drive provided by the driving means to the receiver in the filtering mode. Applying CA amounts to self-adjusting at least one of the filter parameters (e.g., G2(F)) depending on the result of the comparison.

In step 483 of FIG. 18, the accumulated sum-of-squares FIR(F) information is stored in the storage table called FIRS(F). This permits FIR(F) to be reinitialized in step 485 and for the stored information in FIRS(F) to be repeatedly sent (typically 500 times) to the host computer 14 in step 473 until FIRS(F) is updated the next time in step 483.

In step 485, reinitialization to zero of index N1, second accumulator variable M1, and digital filter sum-of-squares accumulator FIR(F) occurs, whence RETURN 471 is reached.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A hearing aid comprising:

a microphone for generating an electrical output from sounds external to a user of the hearing aid;

an electrically driven receiver for emitting sound into the ear of the user of the hearing aid; and means for driving the receiver in a self-generating mode activated by a first set of signals supplied externally of the hearing aid to cause the receiver to emit sound having at least one parameter controlled by the first set of externally supplied signals and for then driving the receiver in a filtering mode, activated by a second set of signals supplied externally of the hearing aid, with the output of the external microphone filtered according to filter parameters established by the second set of the externally supplied signals.

2. The hearing aid as set forth in claim 1 further comprising a second microphone adapted for sensing sound in the ear of the user of the hearing aid, and wherein the driving means comprises means coupled to the second microphone for also supplying a signal for external utilization, the signal representing the at least one parameter of the sound controlled by the first set of externally supplied signals.

3. The hearing aid as set forth in claim 2 further comprising an external connector for making available the signal for external utilization from said driving means and for admitting the first and second sets of signals supplied externally of the hearing aid.

4. The hearing aid as set forth in claim 1 further comprising a second microphone adapted for sensing sound in the ear of the user of the hearing aid, and wherein said driving means comprises means responsive to the second microphone for also self-adjusting the operation of the driving means in the filtering mode.

5. The hearing aid as set forth in claim 1 further comprising a second microphone adapted for sensing sound in the ear of the user of the hearing aid, and wherein said driving means comprises means responsive to the second microphone for comparing the output of the second microphone with the degree of drive provided by the driving means to the receiver in the filtering mode and for then self-adjusting at least one of the filter parameters depending on the result of the comparison.

6. The hearing aid as set forth in claim 1 further comprising a second microphone adapted for sensing sound in the ear of the user of the hearing aid, and wherein the driving means comprises means coupled to the second microphone for also supplying a signal for external utilization, the signal representing a mean-square sound pressure parameter of the sound.

7. The hearing aid as set forth in claim 1 wherein the driving means comprises programmable digital filter means for programmably producing perturbations having a controlled electrical parameter in response to the first set of externally supplied signals, the sound emitted by the receiver having a controlled parameter corresponding to the controlled electrical parameter of the perturbations.

8. The hearing aid as set forth in claim 1 wherein the driving means comprises programmable digital filter means for utilizing the filter parameters established by the second set of externally supplied signals to establish the maximum power output of the hearing aid as a function of frequency.

9. The hearing aid as set forth in claim 1 wherein the driving means comprises means for utilizing the filter parameters established by the second set of externally supplied signals to establish the maximum power output of the hearing aid as a function of frequency and for also supplying a signal for external utilization, the last-said signal representing the number of times as a function of frequency that the established maximum power output of the hearing aid occurs in a predetermined period.

10. The hearing aid as set forth in claim 1 wherein the driving means in the filtering mode comprises programmable digital filter means for performing operations in a plurality of frequency ranges, the operations including filtering followed by limiting followed by filtering.

11. The hearing aid as set forth in claim 1 wherein said receiver comprises a plurality of transducers driven by said driving means in distinct frequency ranges respectively.

12. A hearing aid having a body adapted to be placed in communication with an ear canal, the hearing aid body having an external mircrophone sensitive to external sound, and a receiver for supplying sound to the ear canal, the hearing aid comprising:

a probe microphone in the hearing aid body for sensing the sound present in the ear canal; and means connected to the external microphone and said probe microphone for driving the receiver in response to both the external microphone and said probe microphone, and for generating a digital signal for external use in adjusting the performance of the hearing aid, the digital signal representing at least one parameter of the sound sensed by the probe microphone.

13. The hearing aid as set forth in claim 12 wherein the driving and generating means comprises digital filtering means having at least one external connector for making the digital signal externally available and for admitting additional digital signals so that the digital filtering means can be programmed when the hearing aid is placed in communication with the ear canal.

14. The hearing aid as set forth in claim 12 wherein the driving and generating means comprises means for generating the digital signal to represent the mean-square pressure of the sound sensed by the probe microphone.

15. The hearing aid as set forth in claim 12 wherein the driving and generating means comprises a multiplexer having respective inputs for coupling to said probe microphone and to the external microphone, and said multiplexer being coupled to said digital signal processing means.

16. The hearing aid as set forth in claim 15 wherein said driving and generating means further comprises means for coupling the output of the external microphone with preemphasis to one of the inputs of said multiplexer.

17. The hearing aid as set forth in claim 15 wherein said driving and generating means further comprises means for coupling the output of the external microphone with compression to one of the inputs of said multiplexer.

18. The hearing aid as set forth in claim 12 wherein the driving and generating means comprises means for filtering, then limiting, and then filtering the output of the external microphone in a plurality of frequency ranges.

19. The hearing aid as set forth in claim 12 wherein the driving and generating means comprises means for filtering the output of the external microphone according to filter parameters establishing the maximum power output of the hearing aid as a function of frequency.

20. The hearing aid as set forth in claim 12 wherein the driving and generating means comprises means for filtering the output of the external microphone according to filter parameters establishing the maximum power output of the hearing aid as a function of frequency and for also generating a second digital signal for external use in adjusting the performance of the hearing aid, the second digital signal representing the number of times as a function of frequency that the established maximum power output of the hearing aid occurs in a predetermined period.

21. The hearing aid as set forth in claim 12 wherein the driving and generating means comprises means for also filtering, then limiting, and then filtering the output of the external microphone according to a set of internal parameters and for self-adjusting at least one of the internal parameters in response to the output of the probe microphone.

22. A hearing aid having a body adapted to be placed in communication with an ear canal, the hearing aid body having an external microphone sensitive to external sound, and a receiver for supplying sound to the ear canal, the hearing aid comprising:

a probe microphone in the hearing aid body for sensing the sound present in the ear canal; and means connected to the external microphone for filtering, then limiting, and then filtering the output of the external microphone according to a set of internal parameters and for self-adjusting at least one of the internal parameters as a function of the output of the probe microphone, thereby to drive the receiver.

23. The hearing aid as set forth in claim 22 wherein said filtering, limiting and self-adjusting means comprises means for also comparing the output of the probe microphone with the degree of drive to the receiver and performing the self-adjusting depending on the result of the comparison.

24. A hearing aid for connection to an external source of programming signals and having a body adapted to be placed in communication with an ear canal, the hearing aid body having an external microphone sensitive to external sound, and a receiver for supplying sound to the ear canal, the hearing aid comprising:

a probe microphone in the hearing aid body for sensing the sound present in the ear canal; and digital computing means in the hearing aid and coupled to the external microphone, to said probe microphone and to the receiver, and adapted for connection to the external source of programming signals, said digital computing means comprising means for loading and executing entire programs represented by the signals and thereby utilizing said probe microphone, the external microphone and the receiver for hearing testing and digital filtering.

25. The hearing aid as set forth in claim 24 wherein said digital computing means further comprises serial interface means for two-way communication with the external source.

26. The hearing aid as set forth in claim 24 further comprising multiplexing means for coupling the digital computing means to the external microphone and to said probe microphone.

27. The hearing aid as set forth in claim 26 further comprising means, connecting the multiplexing means to the external microphone, for applying preemphasis to the output of the external microphone, said probe microphone being connected to said multiplexing means so as to bypass said preemphasis means.

28. The hearing aid as set forth in claim 26 further comprising means, connecting the multiplexing means to the external microphone, for compressing the output of the external microphone, said probe microphone being connected to said multiplexing means so as to bypass said compressing means.

29. A system for compensating hearing deficiencies of a patient, comprising:

a hearing aid having an external microphone, programmable means for filtering the output of the external microphone, and a receiver driven by the programmable filtering means for emitting sounds into the ear of the patient;

means for sensing responses of the patient to sounds from the receiver; and means communicating with the hearing aid and the sensing means, for selectively generating a first set of signals to cause the programmable filtering means in the hearing aid to operate so that the receiver emits sounds having a parameter controlled by the first set of signals, and for then generating in response to said sensing means a second set of signals determined from the controlled parameter and the responses of the patient to the sounds with the controlled parameter to establish filter parameters in the programmable filtering means to cause it to filter the output of the external microphone and to drive the receiver with the filtered output thereby ameliorating the hearing deficiencies of the patient.

30. The system as set forth in claim 29 wherein said programmable filtering means comprises digital computing means for programmably producing perturbations having an electrical parameter controlled by the first set of signals, the controlled parameter of the sounds corresponding to the controlled electrical parameter of the perturbations.

31. The system as set forth in claim 29 wherein said hearing aid further comprises a probe microphone for sensing the actual sound in the ear of the patient, and the programmable filtering means comprises means responsive to the probe microphone for also producing a signal for communication to the generating means representing the controlled parameter of the sound.

32. The system as set forth in claim 29 wherein said programmable filtering means comprises means for also producing a signal for communication to the generating means representing the number of times as a function of frequency that a preestablished level of power output of the hearing aid occurs in a predetermined period.

33. The system as set forth in claim 29 further comprising means controlled by the generating means, for selectively producing hearing test sounds in the vicinity of the hearing aid.

34. The system as set forth in claim 29 wherein the programmable filtering means comprises first digital computing means and first serial interface means in the hearing aid and the generating means comprises second digital computing means and second serial interface means communicating with said first serial interface means.

35. The system as set forth in claim 29 wherein said generating means comprises means for also downloading an entire digital filter program to the hearing aid through the second set of signals.

36. The system as set forth in claim 29 wherein said generating means comprises means for also downloading an entire test sound generating program to the hearing aid through the first set of signals.

37. The system as set forth in claim 29 wherein said generating means comprises means for also graphically displaying hearing threshold, uncomfortable loudness level, and performance characteristics of the hearing aid, and for generating a third set of signals determined by interaction with an operator for establishing adjusted filter parameters in the programmable filtering means.

38. A system for compensating hearing deficiencies of a patient, comprising:

a hearing aid having an external microphone, a programmable digital computer in the hearing aid and fed by the external microphone, a receiver fed by the programmable digital computer for emitting sounds into the ear of the patient, and a probe microphone for sensing the actual sound in the ear of the patient;

a data link; and means for selectively supplying at least a first set and a subsequent second set of digital signals to said data link, said data link communicating the digital signals to said programmable digital computer of said hearing aid;

said programmable digital computer comprising means for selectively driving said receiver so that at least one sound for hearing testing is emitted into the ear in response to the first set of digital signals, for supplying to said data link a third set of digital signals representing a parameter of the output of said probe microphone, and for subsequently filtering the output of said external microphone in response to the subsequently supplied second set of digital signals to drive said receiver in a manner adapted for ameliorating the hearing deficiencies of the patient.

39. The system as set forth in claim 38 further comprising means for producing hearing test sounds for the hearing aid, and wherein said supplying means comprises means for also controlling the hearing test sound means.

40. The system as set forth in claim 38 wherein said hearing aid also includes a memory having hearing aid calibration data stored therein and said supplying means comprises means for also retrieving the calibration data from said hearing aid memory and utilizing the calibration data and the parameter of the probe microphone output in supplying the second set of digital signals.

41. The system as set forth in claim 38 wherein said supplying means comprises means for downloading to the hearing aid entire computer programs represented by the first and second sets of digital signals.

42. The system as set forth in claim 38 wherein said supplying means comprises means for also causing the digital computer in the hearing aid to utilize the output of the probe microphone in self-adjusting at least one parameter of its filtering operation.

43. For use in a system for compensating hearing deficiencies of a patient, including a hearing aid having an external microphone, a digital computer in the hearing aid fed by the external microphone, a receiver fed by the digital computer for emitting sounds into the ear of the patient, and a probe microphone for sensing the actual sound in the ear of the patient, signal supplying apparatus comprising:

interface means for performing two-way digital serial communication with the digital computer in the hearing aid; and means for initiating transmission of a first set of signals from said interface means to the hearing aid to cause the digital computer in the hearing aid to operate so that the receiver emits sounds having an adjustable parameter, for obtaining, through the interface means, data representing values of the adjustable parameter of the sounds as sensed by the probe microphone, and for then initiating transmission from said interface means of a second set of signals determined at least in part from the values of the parameter of the sensed sounds to cause the digital computer in the hearing aid to filter the output of the external microphone and drive the receiver with the filtered output, thereby ameliorating the hearing deficiencies of the patient.

44. Signal supplying apparatus as set forth in claim 43 further comprising an acoustic source for providing hearing test sounds to the external microphone and controlled by the initiating means.

45. Signal supplying apparatus as set forth in claim 43 for use with a hearing aid having a memory with hearing aid calibration data stored therein, wherein said initiating means comprises means for also obtaining the hearing calibration data through the interface means, and also utilizing the hearing aid calibration data in determining the second set of signals.

46. Signal supplying apparatus as set forth in claim 43 wherein said initiating means comprises means for downloading a test sound generating program represented by the first set of signals to the hearing aid through said interface means and for downloading a filter-limit-filter digital filtering program represented by the second set of signals.

47. Signal supplying apparatus as set forth in claim 43 further comprising a terminal connected to the initiating means for displaying and adjusting the filtering performance of the hearing aid resulting from the transmission of the second set of signals.

48. Signal supplying apparatus as set forth in claim 43 further comprising means, connected to the initiating means, for sensing responses of the patient to the sounds emitted from the receiver, and wherein said initiating means comprises means for also obtaining data representing the responses of the patient from the sensing means and utilizing the response data in determining the second set of signals.

49. A method for compensating hearing deficiencies of a patient with a hearing aid having an external microphone, electronic means for processing the output of the external microphone, and a receiver driven by the electronic processing means for emitting sound into the ear of the patient, comprising the steps of:

selectively supplying a first set of signals to the hearing aid to cause the electronic processing means to operate so that the receiver emits sound having a parameter controlled by the first set of signals;

sensing and electrically storing representations of responses of the patient to the sound; and supplying a second set of signals determined from the at least one controlled parameter of the sound and the representations of the patient responses to the sound with the controlled parameter to cause the electronic processing means to filter the output of the external microphone and drive the receiver with the filtered output, thereby ameliorating the hearing deficiencies of the patient.

50. The method as set forth in claim 49 wherein the electronic processing means includes programmable filtering means and the first signal supplying step comprises programming the programmable filtering means to produce perturbations having an electrical parameter controlled by the first set of signals, thereby causing the receiver to emit sound having a controlled parameter corresponding to the controlled electrical parameter of the perturbations.

51. The method as set forth in claim 49 wherein the hearing aid further comprises a probe microphone for sensing the actual sound in the ear of the patient, and the method further comprises the step of producing a signal for use in the second signal supplying step representing the controlled parameter of the sound.

52. The method as set forth in claim 51 wherein the electronic processing means includes programmable filtering means having filter parameters established by the second signal supplying step, and the method further comprises the step of causing the programmable filtering means in the hearing aid to utilize the output of the probe microphone in self-adjusting at least one of the filter parameters.

53. The method as set forth in claim 49 further comprising the step of causing the electronic processing means in the healing aid to produce a signal for use in the second signal supplying step representing the number of times as a function of frequency that a preestablished level of power output of the hearing aid occurs in a predetermined period.

54. The method as set forth in claim 49 wherein the second signal supplying step comprises downloading an entire digital filter program for filtering, limiting and filtering to the hearing aid through the second set of signals.

55. The method as set forth in claim 49 wherein the first signal supplying step comprises downloading an entire test sound generating program to the hearing aid through the first set of signals.

56. The method as set forth in claim 49 further comprising the steps of graphically displaying hearing threshold, most comfortable loudness level, uncomfortable loudness level, and performance characteristics of the hearing aid, and generating a third set of signals based on information supplied by an operator for adjusting the filtering performance of the electronic processing means.

57. The method as set forth in claim 49 wherein the hearing aid also includes a memory having hearing aid calibration data stored therein and the method further comprises the steps of retrieving the calibration data from the hearing aid memory and utilizing the calibration data in supplying the second set of signals.

* * * * *